US007908799B2

(12) United States Patent
Mugge et al.

(10) Patent No.: US 7,908,799 B2
(45) Date of Patent: Mar. 22, 2011

(54) WALL BLOCKS, WALL BLOCK KITS, WALLS RESULTING THEREFROM, AND METHODS

(75) Inventors: Jimmie L. Mugge, Inver Grove Heights, MN (US); Jay J. Johnson, Star Prairie, WI (US); Harrison John Brown, Prior Lake, MN (US); Robert Joel Wolter, Chaska, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 135 days.

(21) Appl. No.: 12/322,264

(22) Filed: Jan. 30, 2009

(65) Prior Publication Data

US 2010/0192502 A1 Aug. 5, 2010

(51) Int. Cl.
*E02D 29/02* (2006.01)
*E04B 2/02* (2006.01)
*E04C 1/00* (2006.01)

(52) U.S. Cl. ..... 52/100; 52/98; 52/603; 52/604; 52/606; 405/284; 405/286

(58) Field of Classification Search ..... 52/603–606; 405/284, 286
See application file for complete search history.

(56) References Cited

U.S. PATENT DOCUMENTS 468,838 A 2/1892 Steiger
1,634,357 A * 7/1927 Himmelright ..... 52/98
1,829,435 A 10/1931 Barnhart
4,107,894 A * 8/1978 Mullins ..... 52/592.6
4,186,540 A * 2/1980 Mullins ..... 52/592.6
4,887,403 A * 12/1989 Bonner ..... 52/286
4,896,472 A * 1/1990 Hunt ..... 52/592.6
4,993,206 A 2/1991 Pardo
5,031,376 A 7/1991 Bender
5,062,610 A 11/1991 Woolford
5,107,653 A 4/1992 Lewis
5,252,017 A 10/1993 Hodel
5,402,609 A * 4/1995 Kelley, Jr. ..... 52/98
5,490,363 A 2/1996 Woolford
5,622,456 A 4/1997 Risi
5,653,558 A * 8/1997 Price ..... 405/284
5,704,183 A 1/1998 Woolford
5,709,062 A * 1/1998 Woolford ..... 52/604
5,711,129 A 1/1998 Woolford
5,795,105 A 8/1998 Guth
5,816,749 A * 10/1998 Bailey, II ..... 405/286
5,820,305 A 10/1998 Taylor
6,041,566 A 3/2000 Allen
6,085,476 A 7/2000 Jantzi
6,112,489 A 9/2000 Zweig
6,113,316 A 9/2000 Ash
6,113,318 A * 9/2000 Guth ..... 405/284
(Continued)

OTHER PUBLICATIONS

IBStock Brick Design Guide, Feb. 2001, 12 pages.

*Primary Examiner* — Robert J Canfield
(74) *Attorney, Agent, or Firm* — Merchant & Gould P.C.

(57) ABSTRACT

Concrete wall blocks are described with features facilitating use of the wall blocks to construct each of: a wall section with set back; and, a vertical wall without set back. Wall blocks, kits or sets of wall blocks, and wall sections with various sized blocks are described. Further methods of assembly and use are described. Also, features selectively usable in various types of wall blocks are described.

37 Claims, 26 Drawing Sheets

U.S. PATENT DOCUMENTS

| | | | | |
|---|---|---|---|---|
| 6,474,036 | B2 * | 11/2002 | Martin et al. | 52/604 |
| 6,641,334 | B2 * | 11/2003 | Woolford | 405/284 |
| 6,651,401 | B2 | 11/2003 | Price | |
| 6,953,309 | B1 | 10/2005 | Tufts | |
| 6,984,282 | B2 * | 1/2006 | Weder | 156/251 |
| 7,140,867 | B2 | 11/2006 | Scherer | |
| 7,207,146 | B1 | 4/2007 | Morrell | |
| 7,208,112 | B2 | 4/2007 | Scherer | |
| 7,267,321 | B1 | 9/2007 | Morrell | |
| 7,384,215 | B2 * | 6/2008 | Woolford | 405/284 |
| 7,503,730 | B2 * | 3/2009 | Price | 405/286 |
| 7,712,281 | B2 * | 5/2010 | Bott | 52/604 |
| 2003/0012609 | A1 * | 1/2003 | Woolford | 405/284 |
| 2004/0028484 | A1 * | 2/2004 | Woolford | 405/286 |
| 2004/0159065 | A1 * | 8/2004 | Burgess et al. | 52/574 |
| 2005/0252147 | A1 * | 11/2005 | MacDonald et al. | 52/606 |
| 2006/0153647 | A1 | 7/2006 | Woolford | |
| 2006/0179777 | A1 | 8/2006 | Tufts | |
| 2006/0179780 | A1 * | 8/2006 | Price | 52/604 |
| 2006/0283128 | A1 * | 12/2006 | Price et al. | 52/604 |
| 2007/0166112 | A1 * | 7/2007 | Risi | 405/284 |
| 2008/0060313 | A1 * | 3/2008 | Edwards | 52/606 |
| 2009/0260314 | A1 | 10/2009 | Mugge | |

* cited by examiner

WALL BLOCKS, WALL BLOCK KITS, WALLS RESULTING THEREFROM, AND METHODS

FIELD OF THE DISCLOSURE

The present disclosure relates to wall blocks usable, for example, to create walls. The wall blocks are typically concrete, for example dry cast concrete. The blocks can be configured to be readily usable to create each of: mortarless retaining walls with set back; and, vertical walls without set back. Features providing for variability of block use are described. Also, wall block kits including multiple wall blocks of different size usable with one another to form each of: set back walls; and, vertical walls are described. Also, methods of manufacture and use are described. Further, selective advantageous wall block features are described.

BACKGROUND

Wall blocks usable to form mortarless walls with set back are well known. Examples are described for example in U.S. Pat. Nos. 5,795,105; 5,490,363; 5,704,183; and, 5,711,129, the complete disclosures of each being incorporated herein by reference. In general, when it is said that a wall block is configured for forming a mortarless wall with set back, it is meant that the wall block is configured to engage other analogous blocks with set back such that mortar is not needed to secure the blocks within the wall. An example system for providing such mortarless assembly is described for example in U.S. Pat. No. 5,704,183 and comprises a locator/receiver arrangement wherein: each block includes a locator or locator arrangement thereon, typically extending upwardly from an upper surface of the block, and oriented to be engaged by a receiver, typically oriented in a side and bottom of an adjacent block, when the adjacent block is positioned "on bond." In the system of U.S. Pat. No. 5,704,183, for example, each block includes a locator on an upper surface and a pair of insets on opposite sides which extend through the block. When a block is oriented with an identical block in half-overlap, i.e., "on bond," the protrusion on one block will extend into one of the insets of an identical block above the first block. Interference between the locator and the inset can be used to ensure that blocks in a second course above a first course, are positioned appropriately.

It is noted that in some instances a block that is to be used in a mortarless wall, is referred to as "mortarless wall block" or by similar terms.

The present disclosure relates to providing improvements in such blocks, for desired variability in use.

SUMMARY

According to the present disclosure, concrete wall blocks are described. The wall blocks include features such that the blocks can be used to form each of: a section of a wall (for example retaining wall) with set back; and, a section of a vertical (for example free-standing) wall. Example blocks are described which have first and second, opposite, faces that are defined as decorative, so that each type of wall formed with the blocks will be decorative. That is, the set back wall section will have a decorative front face; and, the vertical wall section will have opposite decorative faces.

Example blocks are described with features conveniently configured so that the blocks can be molded using a dry cast mold process, with a bottom of each mold cavity formed from a flat pallet upon which the blocks are seated when removed from the mold.

Also described are block sets, usable to provide variations in appearance of set back walls and vertical walls made with the blocks.

Methods of use and assembly are described. Also described are methods of palleting and block management; field modifications usable for selected wall features; and, methods of forming columns and corners using blocks of the type described, along with an identified corner block (in some instances with field modification).

Also described herein are advantageous features for wall blocks. These features can be implemented with additional features, to provide for the operations described above, or can be implemented in alternate types of wall blocks.

There is no specific requirement that a block, block set or method be practiced with blocks having all of the features described herein, in order to obtain some benefit according to the present disclosure. Further, there is no specific requirement that features be provided in the specific configuration, shape or size described and depicted, to possess functionality.

BRIEF DESCRIPTION OF THE DRAWINGS

in FIG. 10 one of the blocks of FIG. 1 being viewable positioned above the course of FIG. 9.

FIG. 18 being taken toward a first bearing surface comprising a surface having a locator projection arrangement thereon.

in FIG. 37 an upper wall block being depicted in phantom as positioned in half-overlap, on bond, relationship with adjacent wall blocks underneath.

DETAILED DESCRIPTION

I. General Features of Selected Example Wall Blocks According to the Present Disclosure According to the present disclosure, wall block configurations are described. As will be understood from further description below, according to an aspect of the present disclosure, sets of blocks (for example including the blocks of FIGS. 1, 11, 14, and 17) are described herein. Each of the individual blocks of FIGS. 1, 11, 14 and 17 has generally similar features. However the blocks are different in size from one another; the sizes being specifically selected to allow for preferred assembly into a selected wall configuration, if desired.

In general, wall blocks according to the present disclosure are configured to be usable in a vertical wall section, without set back between adjacent wall courses or layers, if desired. In addition, the wall blocks are configured to be usable in a wall section (set back wall section) with a set back between blocks in adjacent courses or layers, if desired. Features which provide for this will be understood from the general descriptions below.

In addition, wall blocks according to the present disclosure can be configured to provide for a decorative face having concave and convex sections. Further, wall blocks according to the present disclosure are shown in examples configured to provide, when desired, opposite exposed decorative faces, in a vertical wall.

In addition, kits or sets comprising a plurality of different sized walls blocks of appropriate sizes and features for interaction with other wall blocks are described, to provide for variation in the configuration and look of a wall section made with the wall blocks. The option between use of the blocks in a vertically oriented arrangement (without set back) with a lower block, or set back arrangement with a lower block, provides desirable variability, as described below.

Further, a feature is described for implementation in wall blocks according to the present disclosure, to facilitate removal of a locator arrangement, when desired, to facilitate fitting the wall blocks together, when a locator arrangement is not desired.

Further, advantageous features for use in wall blocks are characterized herein, that can be implemented in alternate wall blocks, usable independently of other features described herein, to advantage.

II. An Example Wall Block, FIGS. 1-8

In FIGS. 1-8, features of an example first wall block according to the present disclosure are provided. It is noted that there is no specific requirement that a wall block include all of the features described herein, in order to obtain some benefit according to the present disclosure. Further, there is no specific requirement that a wall block include features proportionally to the figures herein, in order to obtain some benefit. Variations in shape and size can be made, without varying from the general principles of the present disclosure.

Figure 1:
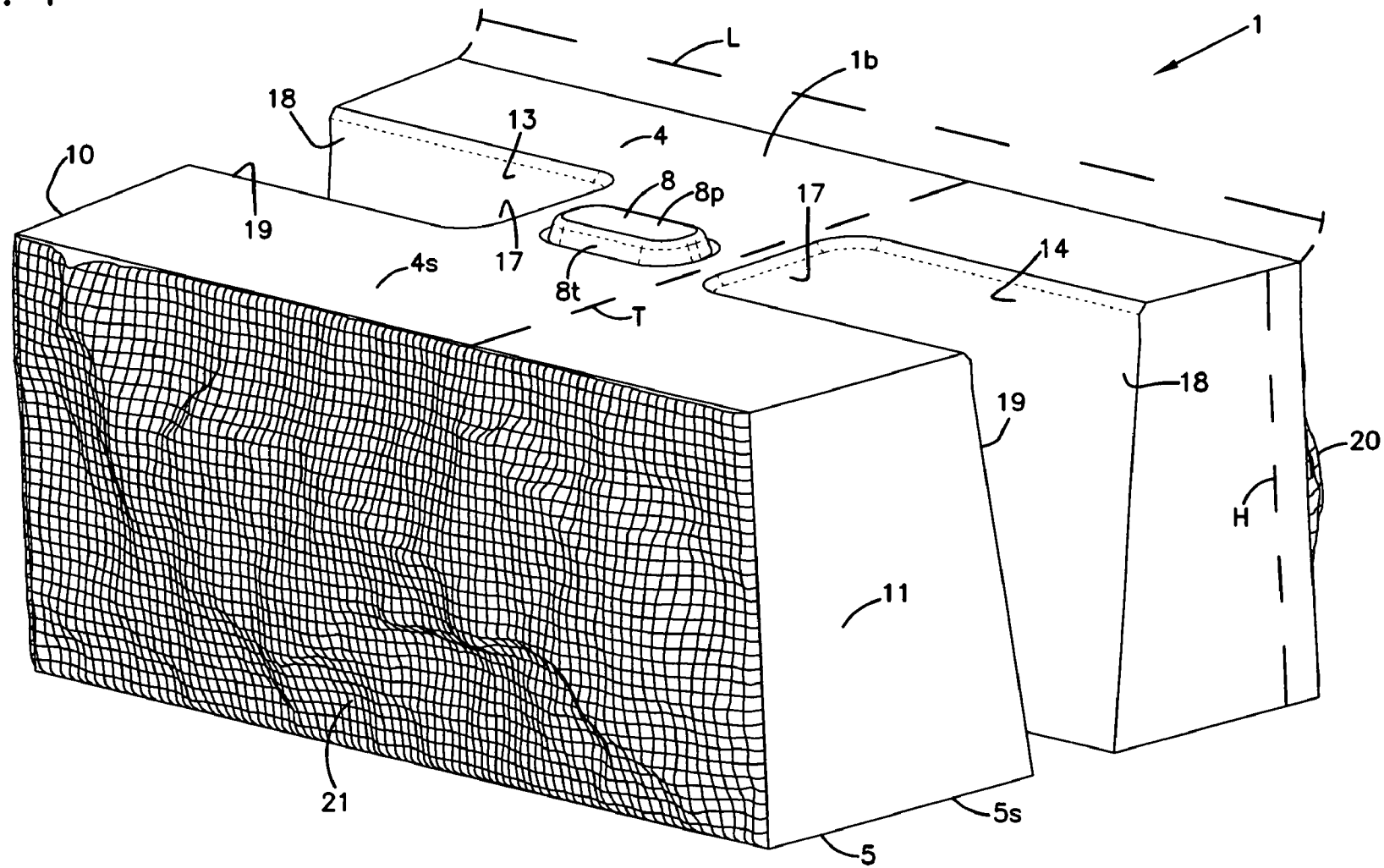
FIG. 1 is a schematic perspective view of an example first wall block according to the present disclosure.

Referring now to FIG. 1, a first wall block 1 is depicted. The first wall block 1 generally comprises a concrete wall block, intended for use to form a wall section. The wall block 1 can comprise, for example, a dry cast concrete block.

Referring to FIG. 1, block 1 generally comprises a block body 1*b* having first and second, opposite, bearing surfaces 4, 5. As the term is used herein, a "bearing surface" is surface which is either directed upwardly or downwardly, in a wall section made with the block. Thus, the bearing surface provides a location where another block or block course above or below can engage when the wall block is used. Thus, in a typical orientation for use, one of the bearing surfaces 4, 5, will be a top or upper surface; and, the opposite one of the bearing surfaces 4, 5 will be a bottom or lower surface.

As will be understood from description below, certain wall blocks according to the present disclosure include an optional feature allowing for the blocks to be selectively inverted relative to adjacent blocks in other courses, for example in a vertical wall section. Thus, the terms "top" and "bottom" only identify a surface as oriented in any given use. In the orientation generally shown in FIG. 1, bearing surface 4 is the top or upper surface and bearing surface 5 is a bottom or lower surface. Of course, as will be described below, in some wall sections, a block in accord with block 1 may be used inverted relative to the orientation of FIG. 1.

Referring to FIG. 1, the first bearing surface 4 has a locator arrangement 8 thereon. In the example block 1, the locator arrangement is a locator projection arrangement comprising projection 8*p* projecting upwardly from a remainder of the surface 4, indicated generally at 4*s*. Although alternatives are possible, typically the remainder surface 4*s* is flat and unfeatured. The locator (projection) arrangement 8 is generally located in a central region of the bearing surface 4, and can provide for selected set back engagement with a second block 1, or an alternate sized or shaped block within a set or kit with which block 1 is used. This will be described further below.

It is noted that the example block 1, the locator (projection) arrangement 8 comprises a single projection. In alternate applications the locator (projection) arrangement can comprise more than one projection. The overall shape of the locator arrangement 8 is a matter of choice, provided it serves the function as described below.

Although alternatives are possible, the opposite bearing surface 5 typically is a planar surface 5*s* generally free from any projection. This will be understood by reference to FIG. 3, a side elevation. Thus, typically bearing surface 5 is flat and planar, with no projecting features thereon. Thus, it will be a general characteristic of a typical wall block according to the present disclosure is that one bearing surface 4 has a locator (projection) arrangement 8 thereon, whereas the opposite bearing surface 5 is generally free from such structure.

Typically, the blocks 1 are configured so that the planar portion 4*s* of the first surface 4 is generally in a plane parallel with the opposite, second, bearing surface 5. This facilitates block use in walls.

Referring, again, to FIG. 1, the wall block 1 has first and second, opposite, sides 10, 11. The sides 10, 11 are often formed as mirror images of one another and typically extend, perpendicularly, between the bearing surfaces 4, 5. Referring to FIG. 1, in the example block 1 depicted each of the sides 10, 11 includes an inset (13, 14 respectively) therein. Referring to inset 14 as an example, in the example block 1 depicted, each inset 13, 14 extends completely between the bearing surfaces 4, 5 and comprises a recess within the corresponding side 10, 11. Thus, each inset 13, 14 has a most recessed wall 17; and, spaced, opposite, first and second recess sidewalls 18, 19.

It is noted that each of the insets 13, 14, is configured so that where it intersects the upper surface 4 a distance between the sidewalls 18 and 19 is greater, than at a location where the same inset intersects the second bearing surface 5. The significance of this is described below.

Figure 2:
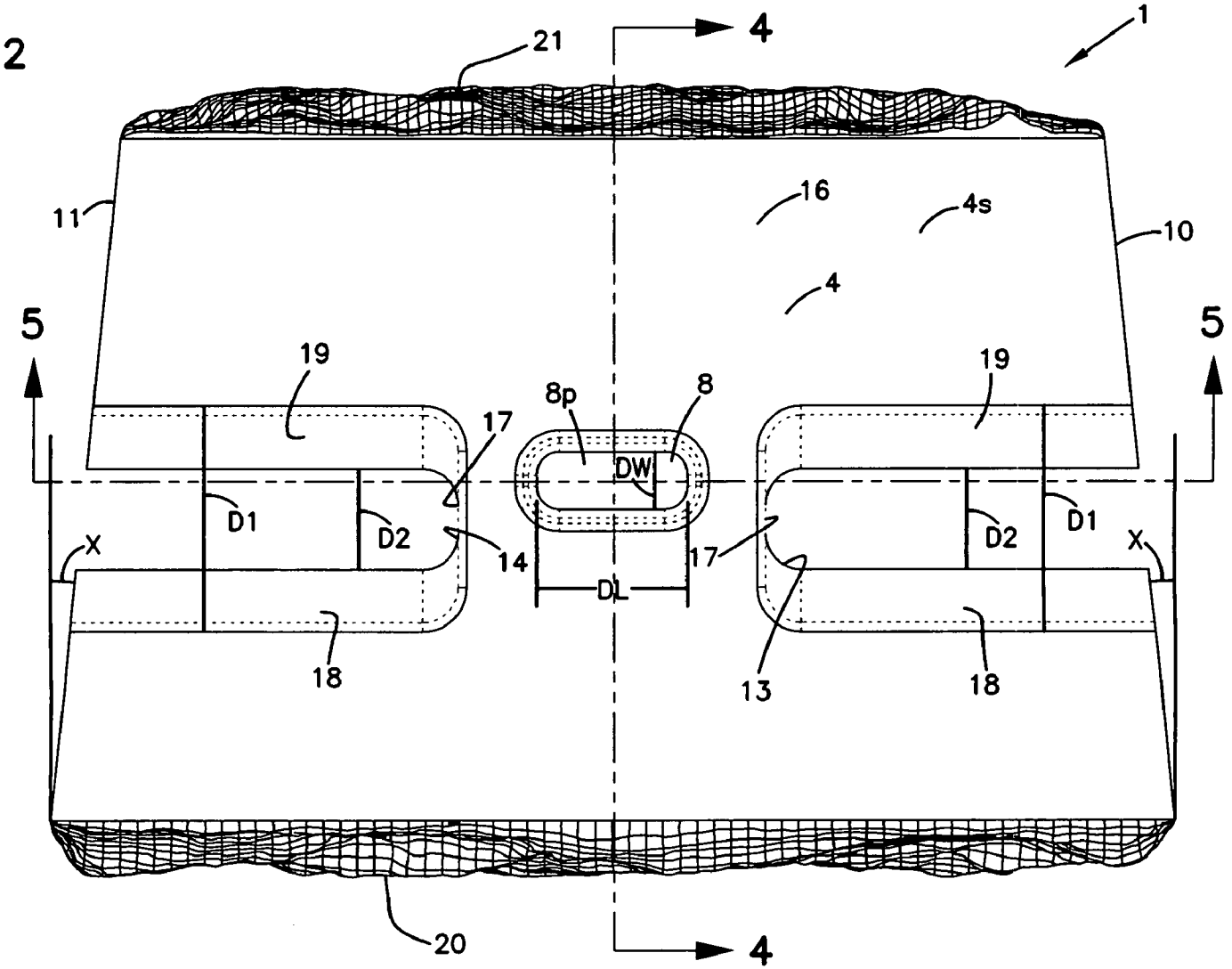
FIG. 2 is a schematic plan view taken toward a first bearing surface of the first wall block of FIG. 1; the first bearing surface being a surface having a locator projection arrangement thereon.

Attention is now directed to FIG. 2, a plan view taken generally toward bearing surface 4. Referring to FIG. 2, the dimension D1 generally shows a dimension between opposite sides 18, 19 of the insets 13, 14, where those insets 13, 14 intersect the first bearing surface 4; and, the dimension D2 shows dimension across the insets 13, 14, in a direction between the inset sidewalls 18, 19, where those insets 13, 14, intersect bearing surface 5.

In general, D1 is greater than D2. Typically, D1 is at least 1.7×D2, and typically a value within the range of 1.7-2.5×D2, inclusive typically 1.9-2.2×D2, inclusive although variations are possible. The dimensions D1 and D2 are set in accord with respect to design/use principles discussed below.

Referring still to FIG. 2, the wall block 1 includes first and second, opposite, faces 20, 21. When first wall block 1 is used in either a set back wall or vertical wall, generally face 20 will be an exposure face, i.e., a face exposed to a viewer of the wall looking toward the wall. In set back wall, opposite face 21 is generally not exposed to view, but rather is directed toward material retained by the set back wall, when the set back wall is used as a retaining wall. On the other hand, when block 1 is used in a vertical wall, especially in a free-standing vertical wall, face 21 will also be an exposure face, i.e., it will form a portion of a wall face viewable to a viewer on an opposite side of the wall from surface 20.

In the example block 1 depicted, each of the faces 20, 21, is a decorative face. The term "decorative face" as used herein as meant to refer to a face that has been designed to have an appearance distinguishing it from a simple planar face made from a concrete mixture. The particular decorative pattern on a given decorative face is typically a matter of choice. Decorative patterns are generally picked to appear attractive, when aligned with other decorative faces of block 1 or other blocks, in a wall section made with block 1. Typically a decorative face 20, 21 is shaped to be contoured convex and concave portions for example, to appear as a section or natural rock.

It is anticipated that in a typical arrangement, the faces 20, 21, will be molded into the blocks 1 when formed. That is, it is expected that typically the faces 20, 21 are molded faces, and are not cut or broken faces. Techniques for forming decorative molded faces have been described in U.S. Pat. Nos. 7,140,867 and 7,208,112, which are incorporated herein by reference.

Referring to FIGS. 1 and 2, it is noted that the decorative faces and the contours therein, are depicted in part defined by gridlines. These gridlines would not generally be observable in the sculpted face product, and are used in the figures to help depict contouring of the various drawings.

Referring to FIGS. 1 and 2, in general, each of the faces 20, 21, extends (in height H) between the bearing surfaces 4, 5, and also (in length or width L) between the sides 10, 11. In typical blocks according to the present disclosure, the faces 20, 21, will extend generally parallel to one another, and generally perpendicularly to the bearing surfaces 4, 5.

Referring to FIG. 2, for the particular block 1 depicted, the sides 10, 11, converge toward one another, in extension from face 20 toward face 21. Preferably the angle of convergence X of each is the same, typically within the range of 3° to 12° and usually about 7.8°.

Herein the term "angle of convergence X" in this context, is meant to refer to an angle between associated ones of the sides 10, 11, and a plane parallel to a direction of extension between the opposite faces 20, 21.

It is noted that many of the features of the present disclosure can be obtained when the sides 10, 11 do not converge, but rather extend parallel to one another. However, the convergence provides advantageous features in set back walls made with blocks according to the present disclosure, relating to facilitating pivoting adjacent blocks to create curved surfaces. This general function from converging surfaces is also described for example in U.S. Pat. No. 5,062,610, which is incorporated herein by reference.

In addition, an angle of convergence X greater than 0° is desirable in vertical walls made with blocks according to the present invention, to key adjacent blocks to one another, as described below.

Further, it is noted that the angle of convergence X for each of the surfaces 10, 11, will typically be the same. However alternates from them can be used in selected wall sections. Indeed modified blocks with respect to this are described herein below, in connection with some possible column arrangements and wall joints.

Attention is now directed in FIG. 2 to locator arrangement 8, again comprising a locator projection arrangement. The locator (projection) arrangement 8 has a first dimension DW thereacross in a direction generally perpendicular to a direction between the first and second faces 20, 21; and, a second dimension DL which generally corresponds to the length of the locator (projection) arrangement 8 in a direction extending between opposite sides 10, 11. The first dimension DW is typically smaller than dimension D2. Typically DW=1.5-2.5 DL, usually about 2×DL, where DW is greatest width of locator (projection) arrangement 8. Since the example locator (projection) arrangement 8, as will be seen in FIG. 3, generally tapers downwardly in size from the surface 4*s* toward the upper tip 8*x*, dimension DW (FIG. 2) would typically be understood to be a widest dimension of locator (projection) arrangement 8. DL (FIG. 2) would be defined analogously.

The locator (projection) arrangement 8 typically is centrally positioned on bearing surface 5. The sidewall 19 of the insets 13, 18, which is furthest from the first, exposure, face 20 is located in a position so that when a second block corresponding to block 1 is positioned on a first block according to block 1 (in a head-to-head, half-overlap, on bond, orientation) depending on which half-overlap occurs, one of the surfaces 19 is positioned to abut the locator (projection) arrangement 8, to define a selected specified set back. That is, the first wall block 1 is configured to be used to generate set back walls, for example retaining walls. The manner in which this is done is generally analogous to that described in patents U.S. Pat. No. 5,795,105, which concerns the use of the insets 13, 14, in combination with a locator (projection) arrangement 8.

In more general terms, block 1 can be said to have an engagement surface arrangement thereon. The engagement surface arrangement includes a feature allowing for engagement with the locator (projection) arrangement when a second block 1 is positioned below the block 1 in either of two possible half-overlap, on bond, orientations, relationships or engagements. Herein the term "half-overlap, on bond," orientation and variants thereof is meant to refer to a positioning of two defined blocks, one above the other each having a first face 20 directed in the same direction, i.e., head-to-head, the upper block shifted to one or the other side of the lower wall block, in a half-overlap orientation with the upper block orientated with the engagement surface arrangement abutting the locator (projection) arrangement so that the defined set back occurs. A typical selected set back will be no greater than 1.0 inch (2.54 mm), usually no greater than 0.75 inch (19 mm); and, typically no greater than 0.5 inch (12.7 mm). The particular block 1 depicted in FIG. 1, as will be understood from discussion further below, is configured for a set back of 0.42 inch (10.7 mm) Typically, the set back will be configured to be at least 0.1 inch (2.5 mm).

Figure 3:
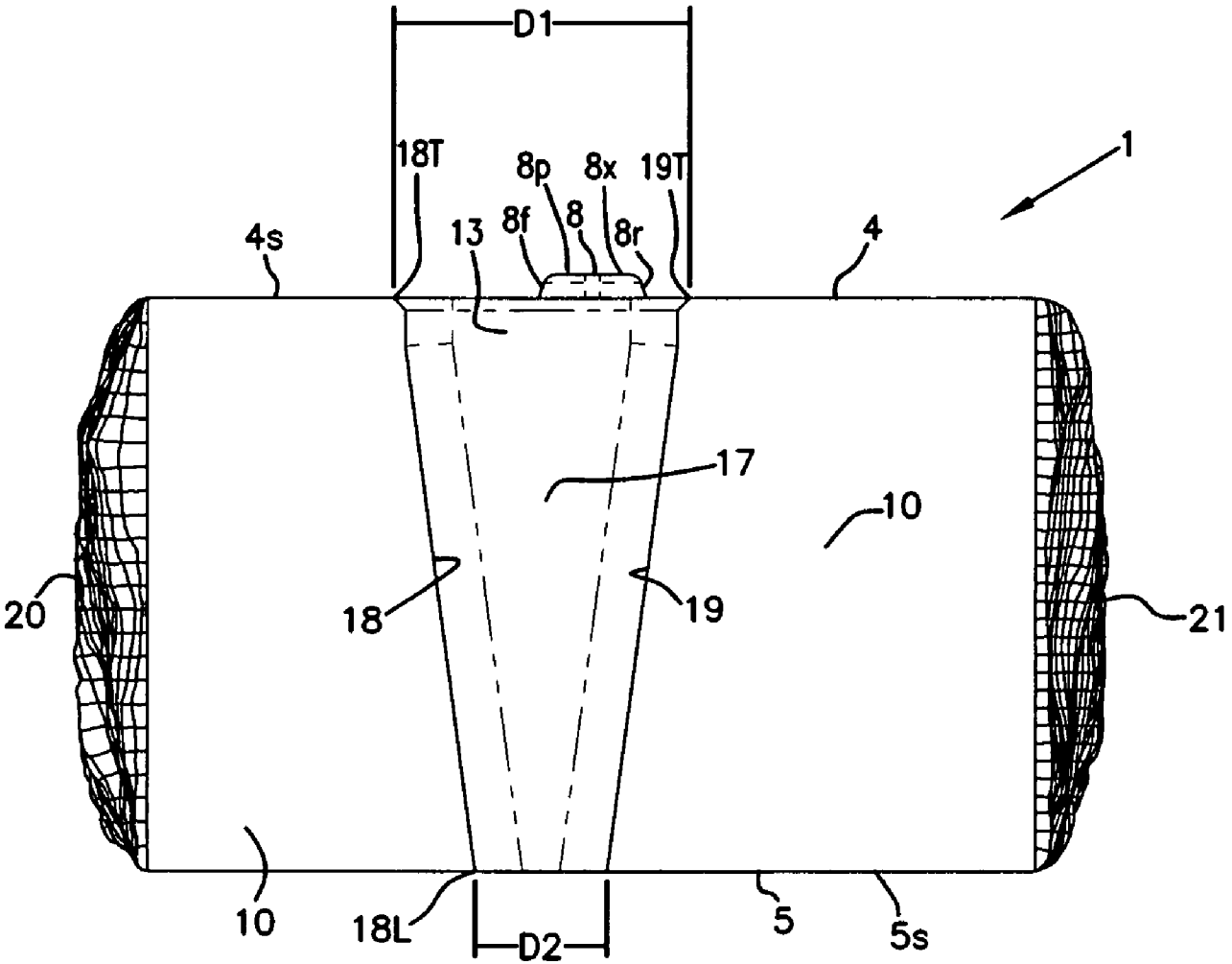
FIG. 3 is a schematic first side elevational view of the first wall block of FIGS. 1 and 2.

Attention is now directed to FIG. 3. FIG. 3 is a side elevational view of the block of FIGS. 1 and 2, generally taken toward side 10. Thus, the inset 13 in side 10 is viewable schematically. It is noted that locator (projection) arrangement 8 is also viewable in side view, with sides extending upwardly at an angle to horizontal. The angle is typically within the range of 60°-80°, inclusive.

Referring to FIG. 3, attention is directed to the intersection of the inset 13 with the lower bearing surface 5. Dimension D2 defines a distance between front and rear surfaces 18, 19 of the inset 13 adjacent bearing surface 5. Front wall 18 of the insert 13 is shown intersecting the lower bearing surface 5, along edge 18L. The wall 18 is referred to herein as a "front wall," since it is the inset wall located closest to the exposure face 20. At 191, intersection between rear wall 19 of inset 13 with bearing surface 5 is depicted. Again, the location of 19L is selected, relative to a rear edge 8*r* of locator (projection) arrangement 8 (opposite from edge 8*f*) such that when a locator (projection) arrangement 8 of a second block analogous to block 1 is positioned underneath block 1 in a half-overlap, on bond, configuration, the rear portion 8*r* of the locator arrangement on a lower block will engage the edge 19L of the next upper block. In this manner, again, locator arrangement 8 operates as locator to achieve a selected, defined, set back. The other inset 14, in side 11, would be configured to operate analogously.

Attention is again directed to the locations 18L, 19L where the surfaces 18, 19 of the inset 13 intersect the lower bearing surface 5. The distance between intersection 18L and intersection 19L is, again, generally represented as D2, FIGS. 2 and 3. The distance D2 is generally selected to be wider than dimension DW, FIG. 2, for ease of installation. Typically, it is selected to be sufficiently wider so that the block can be, positioned, in half-overlap, on bond, with an identical block, with the upper block rotated from a linear alignment with a lower block, in order to create arced walls (curving either inwardly or outwardly). For the example shown, the dimension D2 is approximately 1-1.3×DW, inclusive.

Attention is now directed to dimension D1, FIG. 3. Dimension D1 is the dimension across a recess formed by the inset 13 between the opposite walls 18, 19, where the walls 18, 19 intersect the bearing surface 4 having the locator (projection) arrangement 8 thereon. For example, inset wall 18 intersects surface 4 at 18T, and wall 19, intersects surface 4 at 19T. The distance D1 is generally selected to be sufficiently larger than dimension DW, FIG. 2, so that two effects are achieved:

(1) when block 1 is positioned inverted, i.e., with bearing surface 14 directed downwardly, on a second block 1 that is not inverted (i.e., with a locator (projection) arrangement 8 projecting upwardly) in each of two head-to-head vertical (half-overlap, on bond) relationships the locator (projection) arrangement 8 on the lower block projects upwardly into an inset (13, 14) on the upper block and a locator (projection) arrangement 8 on the upper block projects into an inset of the lower block; and, (2) when block 1 is positioned inverted, i.e., with bearing surface 4 directed downwardly, with a second block 1 that is not inverted (i.e., has a locator (projection) arrangement projecting upwardly) in either of two a head-to-toe vertical (half-overlap, on bond) relationships the locator (projection) arrangement 8 on the lower block projects upwardly into an inset (13, 14) on the upper block, and the locator (projection) arrangement 8 on the upper block projects into an inset on the lower block.

This capability generally allows a block 1 (that is usable in a section of a set back wall) to also be used in a section of a vertical wall. This is described farther below. Herein, when it is said that two blocks are oriented in "head-to-head" orientation (relationship or engagement), or by similar terms, it is meant that the first face 20 of one is directed in the same general direction as the first face 20 of the other. When it is said that this occurs in a "half-overlap, on bond" relationship, engagement or orientation, an analogous definition to that previously used is meant. When it is said that two adjacent blocks are oriented in "head-to-toe" relationship (orientation or engagement) to one another, or by similar terms, it is meant that the first face 20 of 1 is generally directed generally oppositely of the first face 20 of the other.

Herein, when two blocks are oriented with a first bearing surface of one engaging a first bearing surface of the other, they are sometimes characterized as being in a "first bearing surface-to-first bearing surface" relationship, orientation or engagement. Analogously, when two blocks are oriented with a second bearing surface of one engaging the second bearing surface of the other, it may characterized as being in a "second bearing surface-to-second bearing surface" orientation, engagement or relationship.

In general terms, block 1 can be said to have a recess arrangement in the first bearing surface and a engagement surface arrangement. The engagement surface arrangement operates, in combination with an appropriately positioned locator (projection) arrangement 8 on a vertically adjacent block in the set back wall or wall section, to define a set back. In the example block 1 depicted, the engagement surface arrangement comprises a location where insets 13, 14, intersect surface 5. The recess arrangement provides for receipt therein of a locator (projection) arrangement 8 on an adjacent block 1 in inverted relationship to bearing surface 4 (directed toward bearing surface 4) in any of two possible half-overlap, on bond orientations, in each of head-to-head or head-to-toe orientations. The recess arrangement for the example block 1, FIG. 3, is located generally at dimension D1, FIG. 3, and for example comprises where the insets 13, 14 intersect surface 4*s*.

It should be understood that the above described capabilities can be accomplished with a wide variety of locator (projection) arrangement, engagement surface arrangement and recess arrangement configurations and combinations. For example: the locator (projection) arrangement can comprise a single projection or a plurality of projections; the engagement surface arrangement can comprise part of an inset that extends completely through the block, or can comprise an appropriately positioned recess in surface 5; and, the recess arrangement can comprise part of an inset that extends completely through the block 1, or it can be a recess arrangement in bearing surface 4. Herein, in the examples depicted, the engagement surface arrangement and recess arrangement together comprise insets extending completely through a block in a direction between the two bearing surfaces, 4, 5, since such a configuration can be conveniently molded with techniques characterized herein below.

Still referring to FIG. 3, it is noted that the particular inset 13 depicted (of which inset 14 is a mirror image) is generally v-shaped, with a wider portion at the top and a narrow portion at the bottom. This configuration is particularly convenient for molding with techniques according to the description below. However, alternate configurations can be used. For the particular inset 13 depicted in FIG. 3, adjacent surface 14, the slant of the opposite sides 18, 19, away from one another, is depicted as modified. This will typically be acceptable, if the block is molded as described below, as long as the walls 18, 19 are not turned back towards one another as they extend upwardly, since this would create potentially difficult mold undercut.

Figure 4:
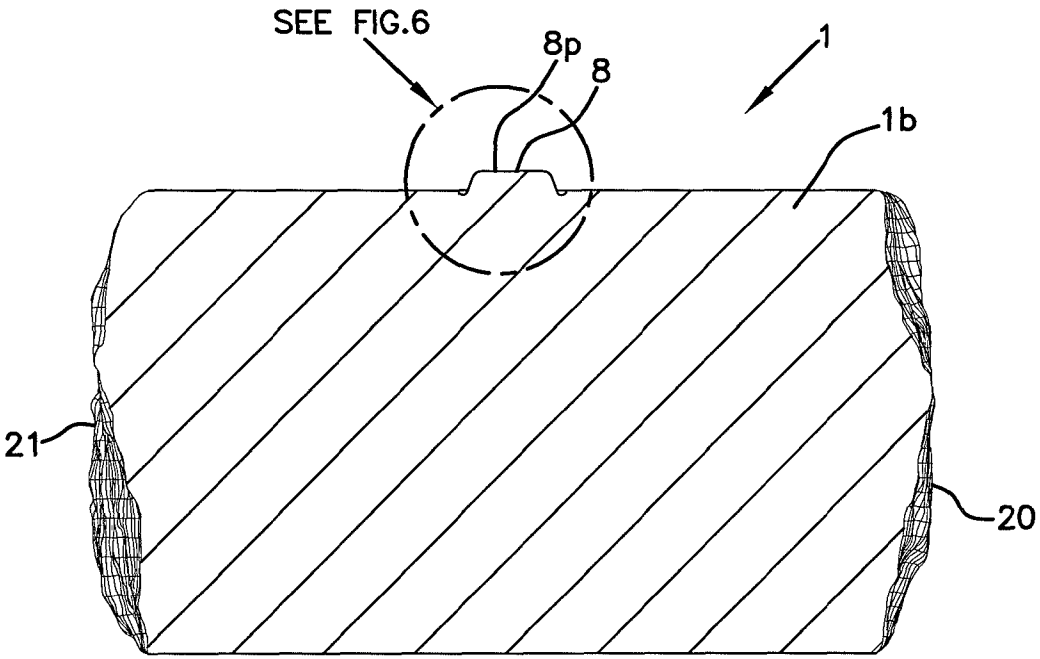
FIG. 4 is a schematic cross-sectional view of the first wall block of FIGS. 1-3, taken generally along line 4-4, FIG. 2.
Figure 6:
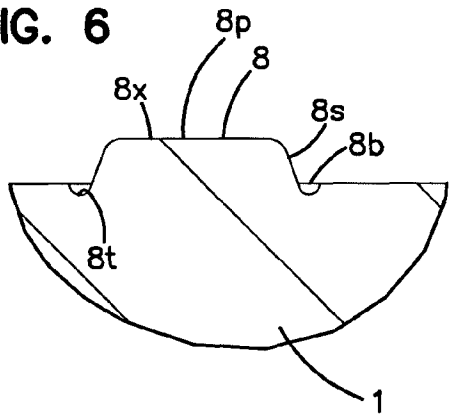
FIG. 6 is an enlarged, schematic, fragmentary view of a selected portion of FIG. 4.

Attention is now directed to FIG. 4, a schematic cross-sectional view taken generally along line 4-4, FIG. 2. The cross-sectional view is basically through a center of block 1, in a plane extending between the first decorative surface 20 and the opposite second decorative surface 21. In FIG. 4, a cross-sectional view of locator (projection) arrangement 8 is provided. An enlarged fragmentary view of the cross-section of locator 8 is viewable in FIG. 6. Referring to FIG. 6, it can be seen that the locator (projection) arrangement 8 includes a sidewall 8*s* which tapers inwardly (typically at an angle to horizontal within the range of 60°-80°, inclusive) for example 70° in extension upwardly from a base at 8*b*, to the top 8*x*. Surrounding the locator (projection) arrangement 8 is provided a recess trough 8*t*. The recess trough is typically at least 0.02 inch (0.5 mm) deep, usually within the range of 0.02 to 0.1 inch (0.5-2.54 mm) deep. The trough 8*t* facilitates removal of the locator arrangement 8 in the field, if desired for the particular wall construction being made. That is, using a chisel or other tool, locator 8 can be sufficiently removed so that any residual portion thereof does not project above surface 4, to advantage.

It is noted that the presence of the trough 8*t* surrounding locator projection arrangement 8 provides additional advantage. First, as will be understood from descriptions below, in a typical process for formation of the block 1, a pressure plate is brought down into a mold, to generate surface 4 and locator projection arrangement 8. When the pressure plate is configured to also form trough 8*t* (around any projection arrangement in the locator projection arrangement 8) it has been observed that the definition of the locator projection arrangement tends to be more consistent to the desired configuration, with less rupture or imperfection. Further, during engagement between the locator projection arrangement 8 and the engagement surface arrangement of a next upper block, in a setback wall section, the next upper block will slide across the trough 8*t*, and engage locator projection arrangement 8 in a slanted surface portion thereof that does not include the lower radius, and is a more sharply and precisely defined portion of the locator projection arrangement 8*t*.

Figure 5:
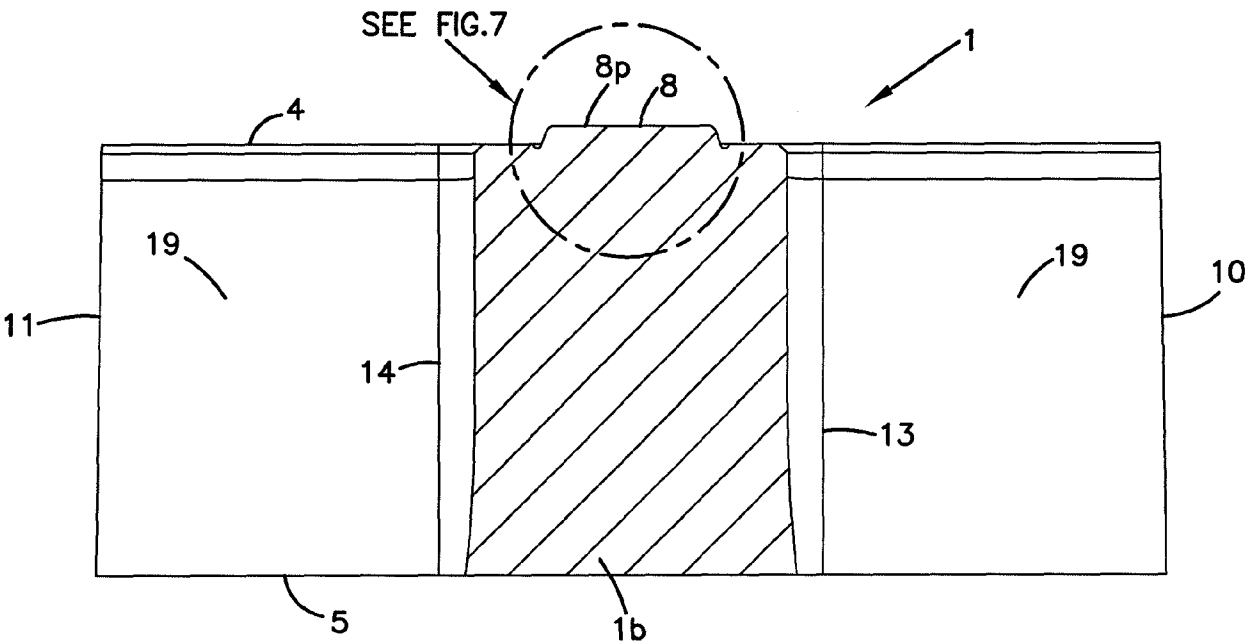
FIG. 5 is a schematic cross-sectional view of the first wall block of FIGS. 1-3, taken generally along line 5-5, FIG. 2.
Figure 7:
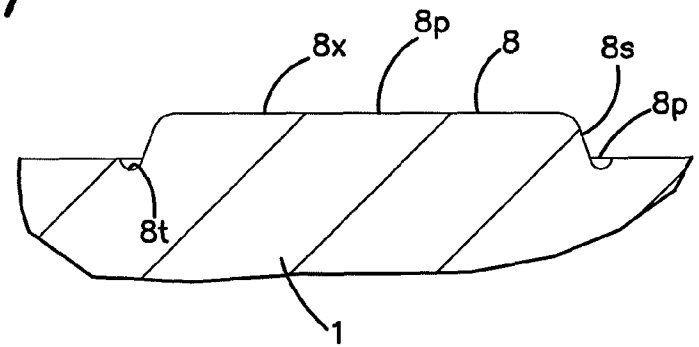
FIG. 7 is an enlarged schematic fragmentary view of a selected portion of FIG. 5.

FIG. 5 is a cross-sectional view taken generally along line 5-5, FIG. 2. In FIG. 6, the cross-sectional view is being taken in the orientation depicted by the arrows on line 6-6, FIG. 2; i.e., orthogonal to the view of FIG. 4. In FIG. 6, the locator arrangement 8 is shown in cross-section. In FIG. 7, an enlarged fragmentary view of a portion of FIG. 5, is depicted and trough 8*t* can again be seen surrounding the locator (projection) arrangement 8.

Figure 8:
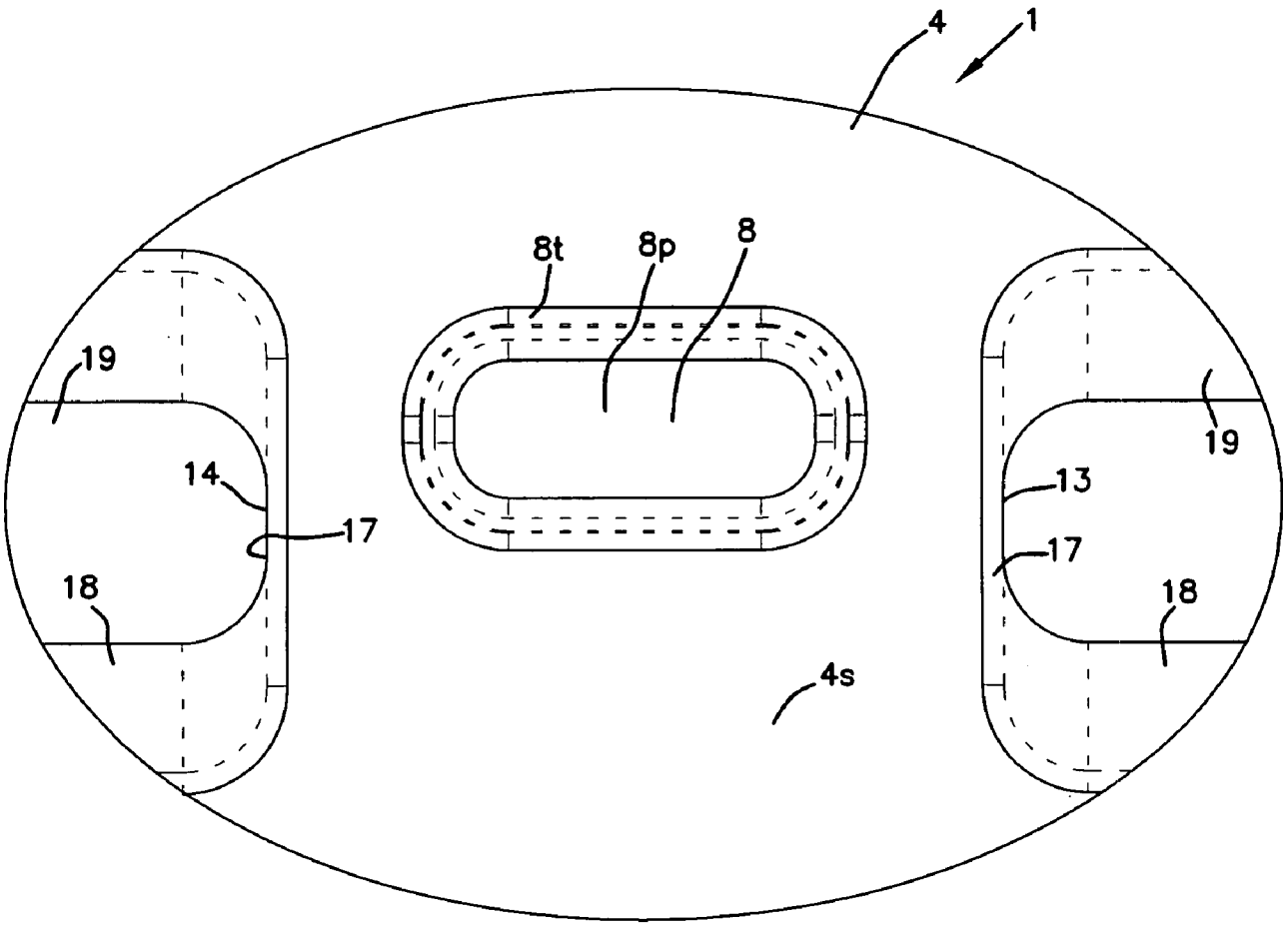
FIG. 8 is an enlarged schematic fragmentary plan view of a portion of FIG. 2.

In FIG. 8, an enlarged schematic, fragmentary, view of an indicated portion of FIG. 2 is depicted. Here the locator (projection) arrangement 8 can be seen positioned between the opposite insets 13, 14.

In general, a block having features in accord with FIGS. 1-8 can be manufactured using variations in conventional block manufacture. The blocks are particularly configured for manufacture in accord with dry cast concrete methods, although many of the same features can be incorporated in blocks manufactured using wet cast approaches.

For a dry cast approach, typically the mold is configured with a mold cavity defined in part by a movable bottom plate or pallet, formed with a flat and featureless upper surface. The mold cavity would include first and second, opposite, movable, mold cavity sides having sculpted or molded surfaces configured to form the opposite decorative faces 20, 21. The sculpted mold surfaces can be made using techniques in accord with U.S. Pat. Nos. 7,140,867 and 7,208,112, for example. The movable walls would generally be configured in the mold to be pivoted away (or otherwise be drawn away) from the sides of the wall block, once formed in the mold cavity, so that block and pallet can be lowered without damage to the decorative wall surfaces 20, 21.

The mold cavity would also include sides configured to form the opposite sidewalls 10, 11 of the wall block 1; these sides including appropriate features therein for formation of the insets 13, 14. These walls would typically not be movable.

The upper end of the mold cavity would be closed by a pressure plate, or stripper. The pressure plate would typically be flat with an appropriate central feature for formation of the locator (projection) arrangement 8; and, if used, the trough 8*t*.

In operation, the movable pallet would be brought into the bottom of the mold, to close the lower part of the mold cavity. The pivotable or movable side pieces would also be positioned in a manner closing the mold cavity. Dry cast concrete, in accord with a mix desired for the intended operation, would be poured into the mold, and the mold would be shaken. The upper pressure plate or stripper would then be pressed against the upper surface of the concrete mix, to compress the mix in the mold and conform it to the mold features. While this pressure is being applied, the locator (projection) arrangement 8 and trough 8*t* would be formed in the upper surface. Of course, this would also provide the decorative faces 20, 21, in the sides.

After the compression step is complete, the sidewalls used to form the decorative surfaces 20, 21, can be moved or pivoted out of the way, and the lower pallet can be dropped, or the mold raised, to free the block from the mold cavity.

While resting on the pallet, the block can be allowed to dry, and then be moved into curing operation.

The molding operation can be conducted in a block making machine configured to form more than one block on the pallet, at the same time, by having multiple mold cavities positioned over the same pallet. In a single block making machine, more than one size or shape of block can be formed, if desired.

The first wall block 1, FIG. 1, can be provided with a variety of general dimensions. In an example system described herein, the block is provided with a first surface 20 that is 16 inches (406 mm) long (or wide, see dimension L) and 6 inches (152 mm) high (see dimension H); and an opposite surface 21 which is 14 (356 mm) inches long (or wide L) and 6 inches (152 mm) high (H). Lengths (T) of the flat portion of the surfaces 4, 5, would typically be the same, in extension between the surfaces 20, 21. In a typical block T would be 9.5 inches (241 mm). The sculpted portions of the surfaces 20, 21 would typically each add an additional 0.75 inch (19 mm) to the size of the block, to dimension T, providing a total dimension of 11 inches (279 mm). The unit weight would be about 64 pounds (29 kg.).

As described herein below, the block 1 is configured to be used as part of a block set, including alternate blocks. However, the block 1 can be used to form each of: (1) a set back wall (for example, in a retaining wall); and (2) a section of a vertical wall (for example, for a free-standing wall) on its own.

The use of block 1 to form a set back wall, is generally in accord with typical mortarless, set back, retaining wall construction for example as described in U.S. Pat. No. 5,062,610.

Figure 37:
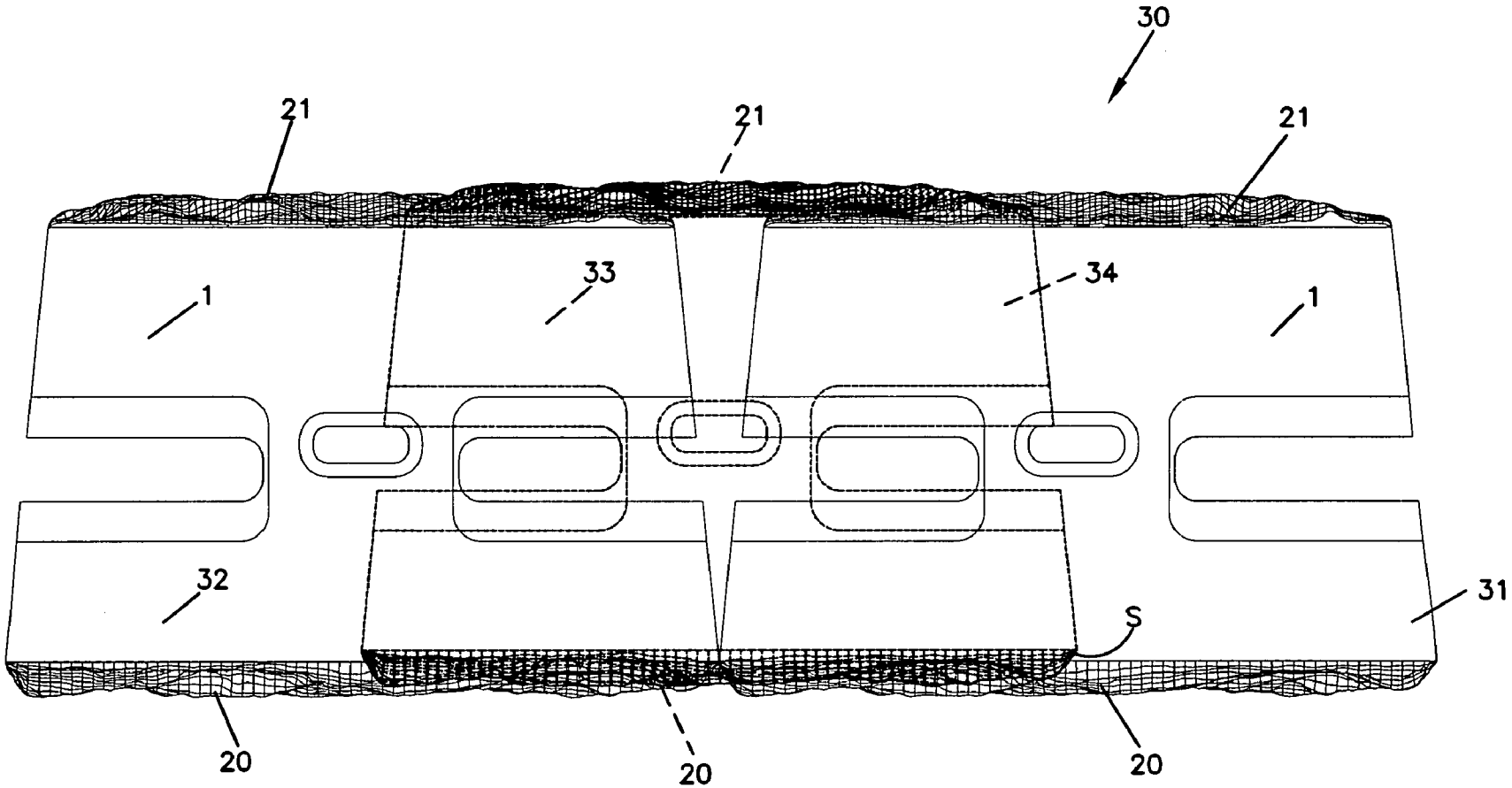
FIG. 37 is a schematic top plan view of a wall section with setback, comprising three wall blocks in accord with FIG. 1.

An example wall section with setback, made with block 1, is schematically in FIG. 37. Referring to FIG. 37, typically, a first course 30 of blocks 1 is positioned with the blocks 1 adjacent one another and head-to-head, see blocks 31, 32, FIG. 37. This wall section can be straight or curved (inwardly or outwardly) as desired. The next course 33 will be positioned above this first course, in half-overlap, on bond, i.e., with each block 34 in the second course in half-overlap with each of two adjacent blocks 31, 32 in the lower course.

In the depiction of FIG. 37, the upper block 33, positioned in half-overlap, on bond, setback relationship with the lower blocks, 31, 32, is depicted in phantom. Referring to FIG. 37, it is noted that the total amount of setback (indicated generally herein by the designation S) is less than an amount by which the decorative faces 20 project forwardly from the bearing surfaces 4. This provides for an attractive decorative appearance in the wall, with setback not clearly exposing to view flat portions of bearing surface 4. In the example depicted in FIG. 37, the setback is about 0.42 inches (10.7 mm), and the amount of projection of the decorative portion 20 forward from the bearing surface 4 is about 0.75 inch (19.1 mm).

In a set back wall, the relationship between two adjacent, vertically exposed, blocks 1 will typically be head-to-head, i.e., with the first face 20 of each extending in generally the same direction, although as described above, some curvature between the two is possible. The set back would be accomplished by applying each block in the upper course in a manner such that the locator (projection) arrangement 8 in each lower block is positioned projecting into an inset of two upper blocks, abutting the forward walls of the insets. Typically, in a setback wall (using blocks in accord with FIGS. 1 and 2), specifically in a retaining wall section with set back, the exposure face of the retaining wall will correspond to the larger decorative face, i.e., face 20, of each block. Herein the term "exposure face," when used in connection with a retaining wall, or block feature in a retaining wall, is meant to refer to the face of the block toward a viewer observing the retaining wall. When the blocks are analogous to block 1, to have one longer decorative face 20 and one shorter decorative face 21, the blocks are orientated to be used in a set back retaining wall with the longer face 20 being implemented in the exposure face, i.e., directed toward the viewer As indicated, wall block 1 is also configured for use to provide a vertical, for example free-standing, wall. Such a wall has no set back and is typically not used for a retaining. With respect to formation of such a wall, attention is directed to FIGS. 9 and 10.

A free-standing vertical wall section made only with a block according to FIG. 1, would generally be constructed as follows. A first course or base would be constructed by positioning blocks 1 according to FIG. 1 adjacent one another (head-to-toe) in a row. Thus each alternate block in the row would be rotated 180°, relative to adjacent blocks. This is shown for example in FIG. 9. Thus, block 1*a* is positioned with face 20 in a first direction, and adjacent block 1*c* is positioned with face 20 directed in an opposite direction. Blocks 1 are snug up against one another, with abutting sides, to form a straight line. The straight line results because the angle of convergence X (FIG. 2) of each sidewall 10, 11, is the same. Of course in some applications, the angles can be modified, for example field modified, to cause a curve or turn in the wall.

Figure 9:
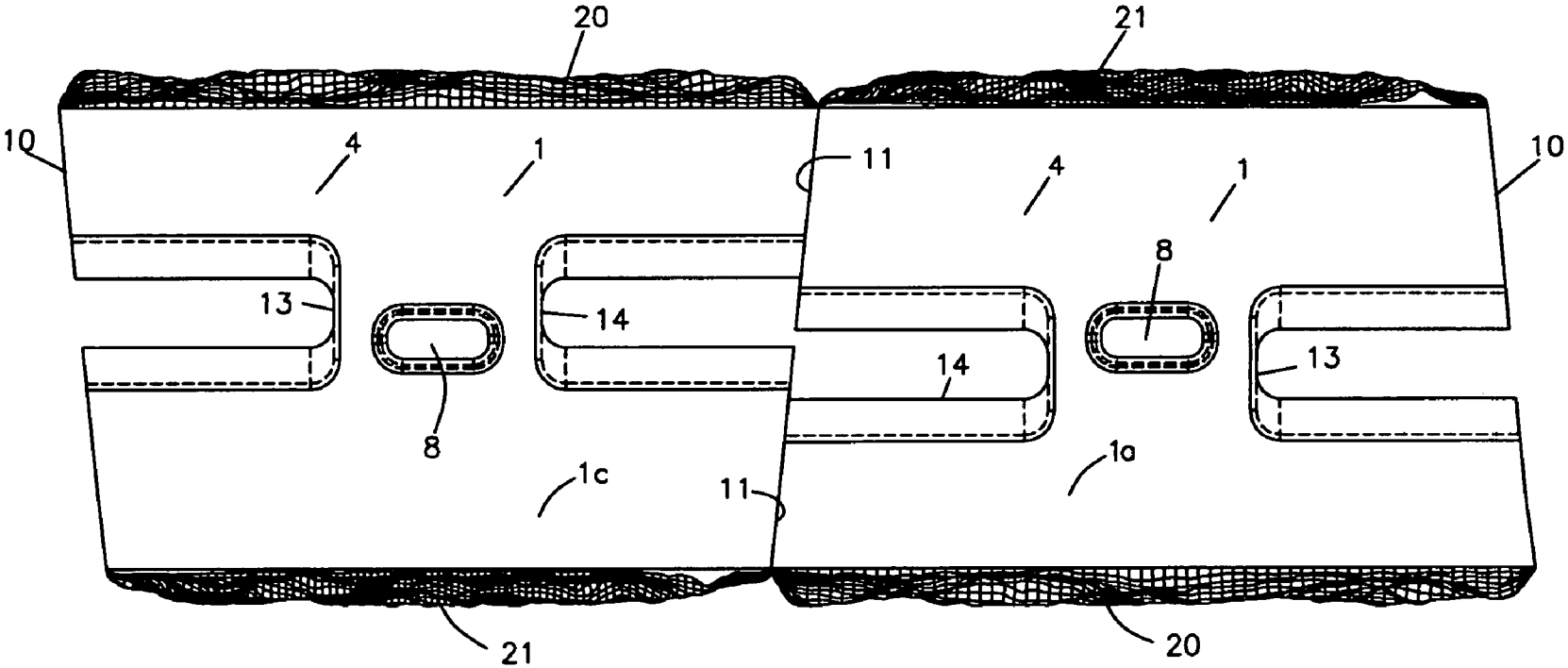
FIG. 9 is a top plan view of a portion of a first course in a vertical wall, without set back, made with two first wall blocks according to FIG. 1.

It is noted that in a row of blocks organized as shown in FIG. 9, any of blocks 1 positioned between two adjacent blocks, will generally be keyed in positioned, with respect to movement in the direction of a face 21 thereon, due to the angled interface between adjacent blocks. This will help provide integrity to the wall, and facilitate installation.

It is noted that in the wall section or course portion depicted in FIG. 9, blocks 1*a*, 1*c*, i.e., adjacent blocks 1, are oriented with the exposure faces (20, 21) on each side of the wall, generally in the alignment (i.e. same approximate plane).

A next course or layer, can be positioned on top of the base layer using block 1. With respect to this, attention is directed to FIG. 10. Here an above block 1*d* in the next course, is shown inverted relative to the lower course comprising blocks 1*a* and 1*c*; i.e., in one course, the first course comprising blocks 1*a* and 1*c*, the blocks 1*a* and 1*c* are oriented with surfaces 4 (having locator (projection) arrangement 8 thereon) directed upwardly. In the next adjacent course, in this instance a course comprising block 1*d*, the block 1*d* is orientated with bearing surface 4, having the locator (projection) arrangement 8 thereon directed downwardly. It can be seen that the locator (projection) arrangements 8 in the lower blocks will generally project up into insets (recesses) on blocks of the upper course; and, the locator (projection) arrangement 8 on the upper block 1*d* would project downwardly inset (recesses) definition provided in the lower course comprising blocks 1*a* and 1*c*. This is a vertical wall, and thus it has no set back. Of course, block 1*d* can be rotated (in the plane of the drawing of FIG. 10) 180° and still be positioned appropriately. Thus, block 1*a* is positioned "head-to-toe" with respect to block 1*c*. Block 1*d*, on the other hand, is positioned in head-to-head with respect to block 1*a*, and head-to-toe with respect to block 1*d*.

Figure 10:
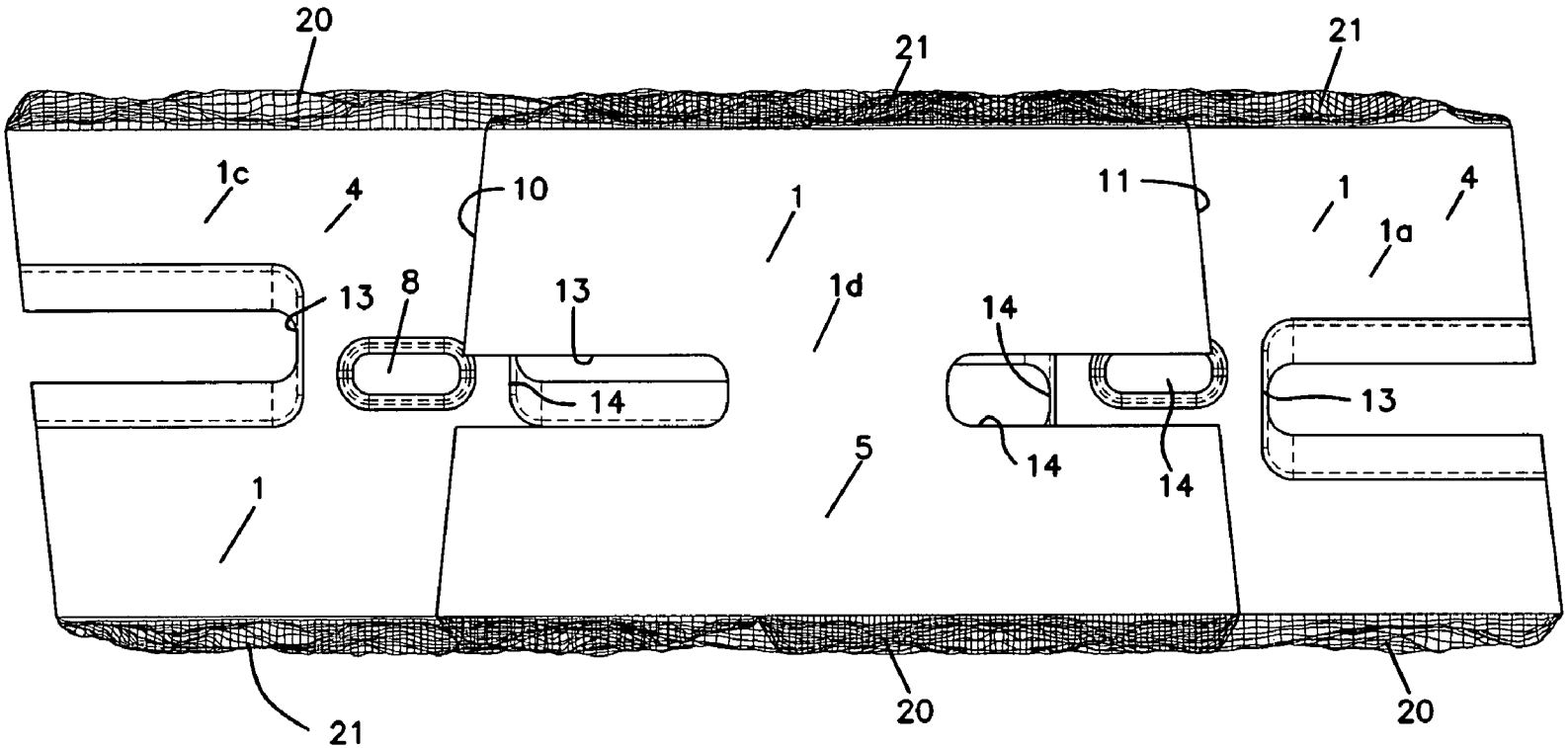
FIG. 10 is a top plan view of a portion of a vertical wall, without set back, made with first wall blocks according to FIG. 1.

Referring to FIG. 10, the relationship between block 1*d* and each one of blocks 1*a* and 1*c*, can be characterized as a "first bearing surface-to-first bearing surface" engagement, relationship or orientation.

Still referring to FIG. 10, it can be seen that a vertical wall with no set back constructed in accord with the principles described herein in connection with FIG. 10 will be a vertical wall having opposite exposure faces that are formed from decorative faces 20, 21 of the individual blocks 1. Thus a wall formed in accord with the description of FIG. 10 would be usable, for example, as a decorative free-standing wall. It is noted that typically in the construction of such a free-standing wall, masonry glue will be used in adjoining faces of vertically adjacent blocks. Also, typically the next (third) course up would comprise blocks each oriented with the locator (projection) arrangement directed upwardly. This would be a "second bearing surface-to-second bearing surface" engagement, relationship or orientation. Typically, in each course adjacent blocks will be positioned at head-to-toe, as the term is used herein.

It is noted that in some instances, it may be desirable to remove a locator (projection) arrangement 8 from a block, to facilitate the wall construction. This can be accommodated by chiseling out the locator (projection) arrangement as previously described.

It is also noted that in some instances it may be desirable to introduce more variability into the decorative surfaces or exposure surfaces of a wall, by using alternately sized or appearing blocks. Blocks to accommodate this as described in the following sections. Also, in later sections methods for creating corners and/or columns are described.

III. Additional Wall Blocks Useable, for Example in a Wall Block Set or Kit Including Wall Block In some instances, it may be desirable to provide for greater variability in a set back wall section or a vertical wall section constructed using wall block 1, FIGS. 1-8. This can be accomplished by generating a wall block kit which includes one or more additional blocks of different size, each configured in accord with analogous principles. Example blocks that can be used in such a wall block are described in this section.

A. An Example Second Wall Block, FIGS. 11-12

Figure 11:
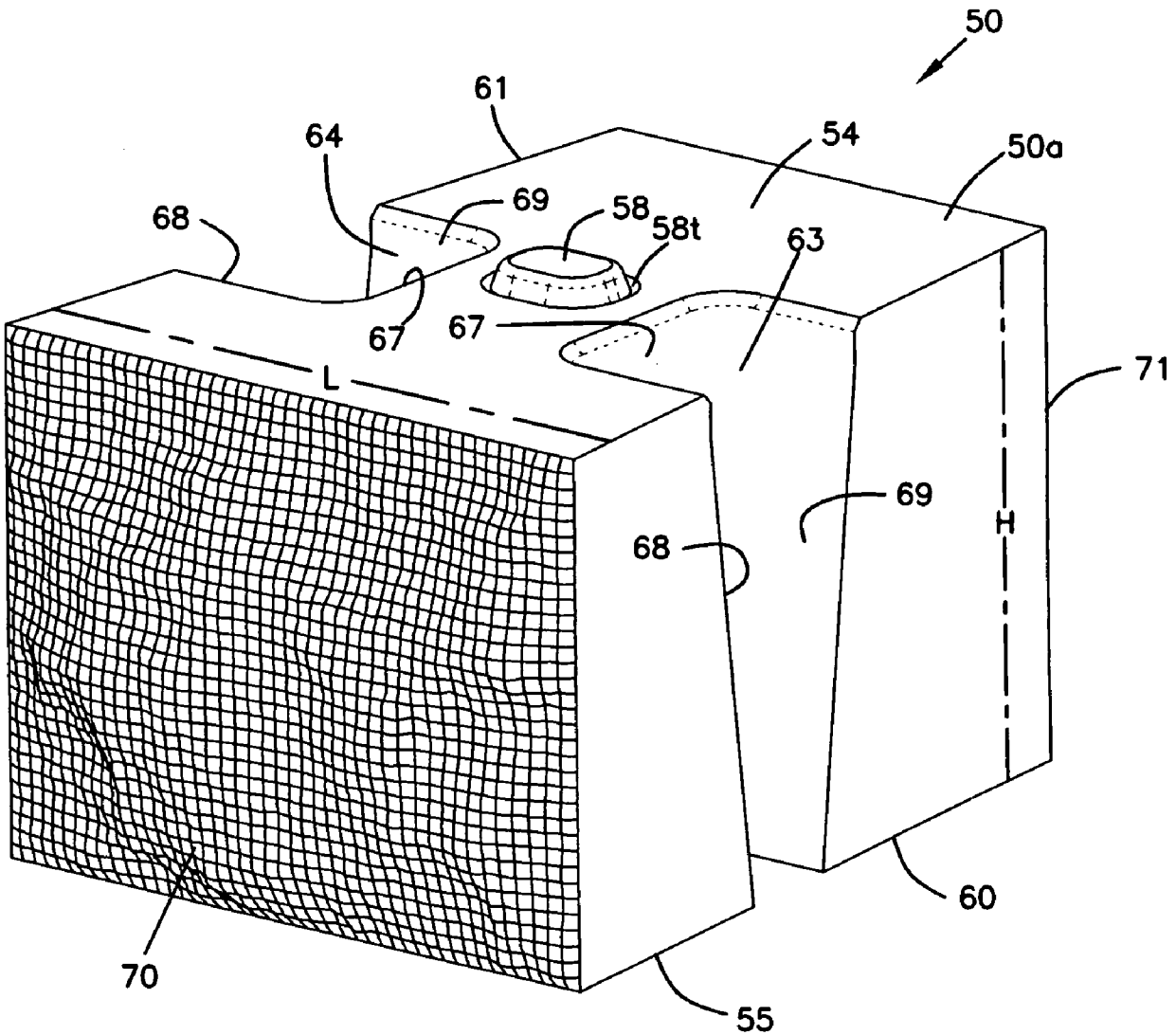
FIG. 11 is a schematic perspective view of an example second wall block according to the present disclosure.
Figure 12:
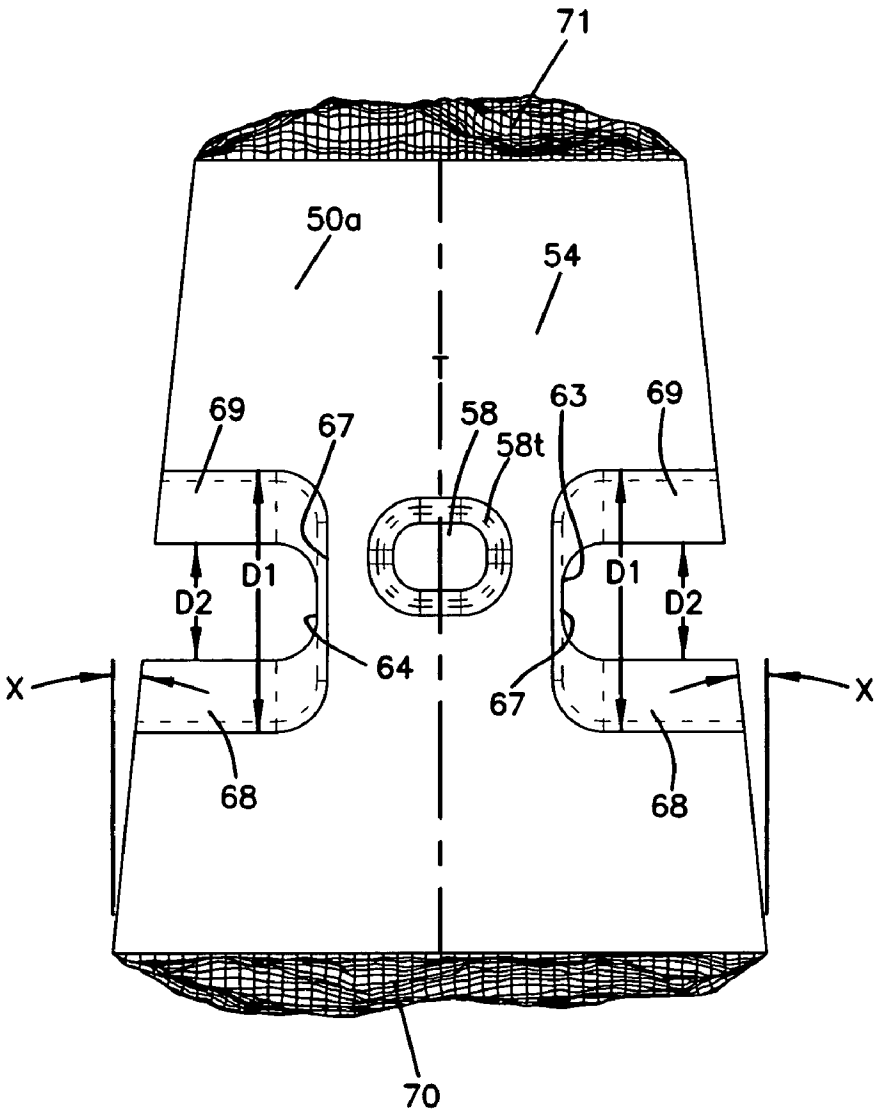
FIG. 12 is a schematic plan view of a first bearing surface of the second wall block of FIG. 10; the view being toward a bearing surface having a locator projection arrangement thereon.

Attention is now directed to FIGS. 11-12. In FIGS. 11-12, a second wall block usable in association with wall block 1, FIGS. 1-8, to form either or both of a wall block section of a set back wall and a wall section of a vertical wall, is depicted. Attention is first to FIG. 11, a perspective view of a second wall block 50. The second wall block 50 includes general features analogous to wall block 1, FIG. 1. However block 50 is configured in a different size.

Referring to wall block 50, the wall block 50 comprises a block body 50*a* and includes a first bearing surface 54 which, when the block is positioned in the orientation of FIG. 1 is a top or upper surface; and, a second, opposite, bearing surface 55. Typically, the second bearing surface 55 is flat and featureless, although alternatives are possible. The first bearing surface 54 includes a locator arrangement 58 thereon, in the example depicted comprising a locator projection arrangement. The example locator (projection) arrangement 58 is surrounded by a trough 58*t*, analogous to trough 8*t*, FIG. 2. Wall block 50 includes first and second, opposite, block sides 60, 61; the sides 60, 61 including insets 63, 64 respectively therein.

Analogously to insets 13 and 14, insets 63 and 64 each include a most recessed wall 67; a first sidewall 68; and, a second sidewall 69. Also, analogously to wall block 1, FIG. 1, wall block 50 includes a first, exposure, face 70 and a second, opposite, face 71.

Although alternatives are possible, block sidewalls 60, 61 converge in extension from face 70 to face 71, and are typically each planar. In the example, each block sidewall 60, 61 extends an angle of convergence X, see FIG. 12, a top plan view of block 50. This would typically be selected to the same for each sidewall 60, 61 as the angle of convergence X for each sidewall of block 1, when block 60 is to be used in a set with block 1, although alternatives are possible.

Still referring to FIG. 12, it is noted that each of the insets 63, 64 has a first dimension thereacross, between sidewalls 68, 69, indicated at D1, where the insets 63, 64 intersect the first bearing surface 54; and, a second dimension D2 between the wall 68, 69, where the insets 63, 64 intersect the lower second bearing surface 55; with D1 greater than D2. Typically, D1 and D2 would selected in the same manner as described for the wall block 1, when the wall block 1 is to be used with wall block 50 as a set.

A side elevational view of block 50 is not depicted, as it would appear generally similar to the side elevational view of block 1, FIG. 3. Indeed the same dimension of insets 63, 64, can be used in the two blocks 1, 50, with the exception that the insets of block 50 are shallower in depth inwardly from the sidewalls 60, 61, than are the insets of block 1, for the reason that, as described below, the block 50 is smaller in dimension between the sidewalls 60, 61 than is block 1.

However, block 50, although configured with overall features analogous to block 1, is different in size. First, the block 50 provides for approximate half the exposure face area when used. Thus, for example, face 70 for the example described block 50, would be the same height (H) but half as wide (long L) as the corresponding surface in block 1. The example block 50 described herein, would have a first surface 70 having a dimension H about 6 inches (152 mm) high and about 8 (203 mm) inches wide (long dimension L).

For such a block, the opposite face 71 would typically have a dimension 6 inches (152 mm0 by 6 inches (152 mm). The depth of the block 50, i.e., distance between the outermost portions the decorative surfaces 70, 71 would also be about the same as block 1, i.e., 11 inches (279 mm). For the examples described, a distance T (FIG. 12) in a direction between the exposure face 70, 71, across the flat portion of surface 54, would be 9.5 inches (241 mm), and the contour faces 70, 71, when used, would each adding an extra 0.75 inch (19 mm) total to the length.

Such a block would have a weight of about 30 pounds (13.6 kg), and would be configured for a wall unit batter (angle of set back) of 4°.

Another difference between block 50 and block 1 relates to the overall size of the locator (projection) arrangement 58. While the locator (projection) arrangement 58 would typically project upwardly the same amount as locator projection arrangement 8, locator projection arrangement 58 would typically be smaller in length, i.e., in direction between the two insets 63, 64, while having approximately the same distance thereacross the width, i.e., distance in a direction between the faces 70, 71.

Again, generally the cross-dimensions D1, D2 of the insets, i.e., dimensions between the first and second walls 69, 69 adjacent the opposite bearing faces 54, 55, would be determined analogously to the same distances in block 1. Adjacent the first or upper bearing surface 54, the insets 63, 64 should be sufficiently wide so that the block 50 can be inverted and be positioned on an identical block (in either of four half-overlap, on bond, relationships) to form a section of a vertical wall, i.e., a wall without set back, while having the locator (projection) arrangement of each one projecting in to a recess (inset) of the other. In addition, block 50 can be positioned in a section of a set back wall, with one block 50 positioned on a identical block 50 in a half-overlap, on bond, relationship, with the locator (projection) arrangement 58 of one engaging the inset at the second bearing surface 55 of the other, to define set back S.

It can be understood that blocks 50 can be used analogously to blocks 1, alone, to form either a wall with set back or vertical wall with opposite exposed, faces. In a vertical wall, the opposite exposed faces would generally be decorative, providing the opposite faces 70, 71 of each block 50 is molded or otherwise made to be decorative. On the other hand, because they are configured with the same height and depth, blocks 50 can be used in cooperation with block 1 to form either a section of a wall with set back or a section of a vertical wall with no set back.

If the intent is to form a wall with set back, blocks 1 and 50 would be used together in an analogous manner to which they would used separately, i.e., preferably with each configured to form the same set back S2. Should a location occur where the locator projection arrangement 8, 58, interferes with a vertically adjacent block, that locator projection arrangement 8, 58, can be chiseled off in the field.

Figure 13:
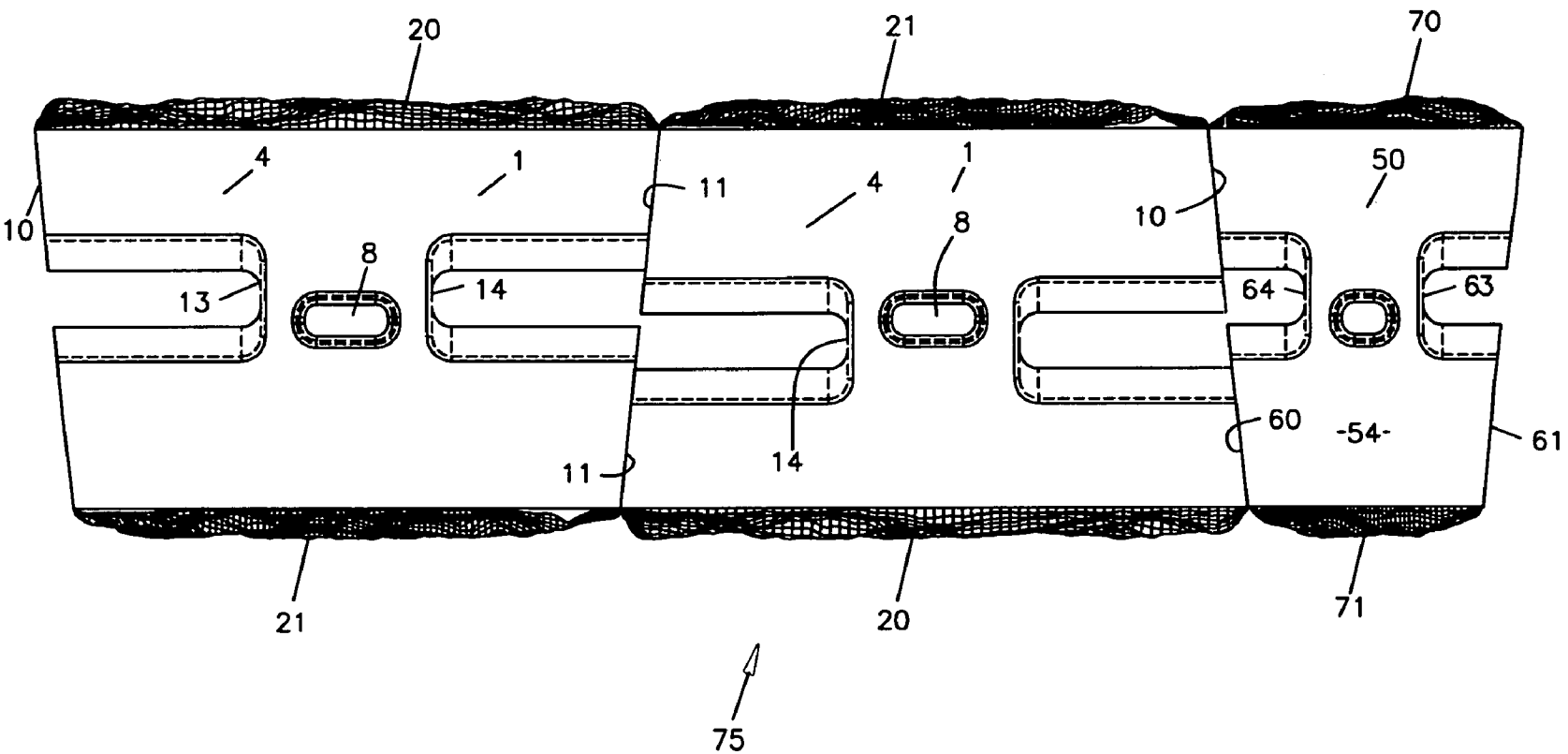
FIG. 13 is a schematic plan view of a portion of wall course in a vertical wall, made using both first and second wall blocks in accord with FIGS. 1 and 11.

Also as indicated, the blocks 1, 50, can be used together to form a vertical wall with no set back. An example of this is illustrated in connection with FIG. 13, where section 75 of a vertical wall is depicted comprising two blocks 1 and one block 50, each two adjacent blocks being oriented in head-to-toe relationship with each next adjacent (to the side) one of the blocks 1, 50. A course, above the course depicted in FIG. 13 will be built analogously to the description above for FIG. 10. In the field, when the vertical wall is created, a person creating the wall can select from among other blocks 1, 50, oriented as desired for desirable appearance throughout the wall, with any two vertically engaging blocks being configured with either: the first bearing surface (4, 54) of one engaging the first bearing surface (4, 54) of the other; or, a second bearing surface (5, 55) of one engaging the second bearing surface (5, 55) of the other. In such a wall section, typically the locator (projection) arrangements (8, 58) are oriented so that they can be received with an inset (recess) of the next vertically adjacent block 1, 50, when positioned above, for example in a half-overlap, on bond, relationship. However, should a location occur in which interference between a locator (projection) arrangement on one block and the next vertically adjacent block occurs, that locator projection can be removed as described previously.

As will be understood from descriptions below, according to the present disclosure blocks 1, 50, are each configured to also be usable in a set with still additional blocks, to provide for still more optional variation in the appearance of a resulting wall, whether set back or vertical. Such blocks are described next.

B. A Second, Alternate, Block, FIGS. 14-16

Figure 14:
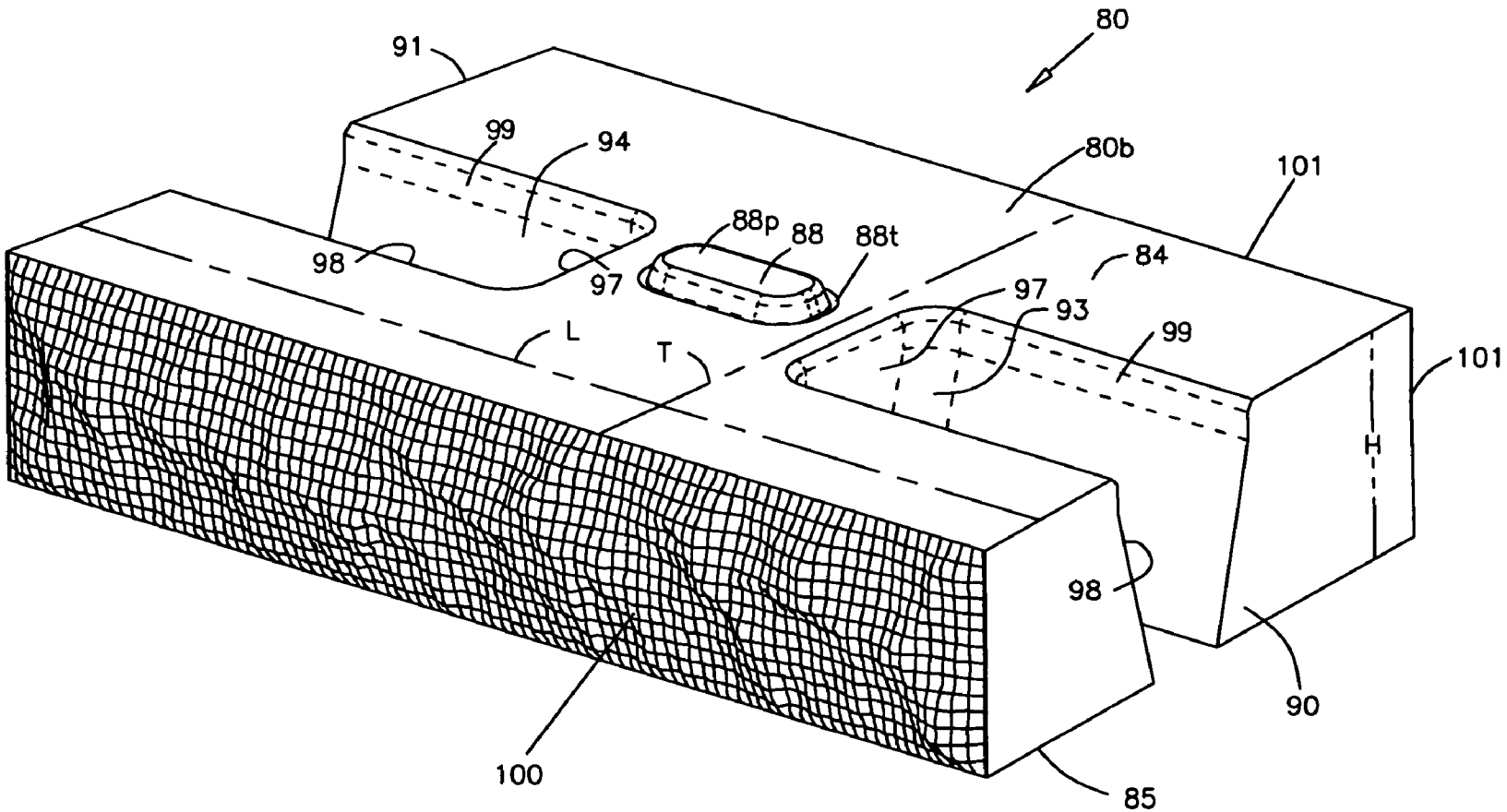
FIG. 14 is a schematic perspective view of an example third wall block usable to form a wall in accord with the present disclosure.

To provide additional variation in sections of walls (set back or vertical) that can be made with blocks in accord with the principles described herein, it is sometimes desirable to provide blocks having variations in height from blocks 1 and 50. Example of such blocks are depicted in FIGS. 14-18 comprising block 80, FIG. 14 and block 120, FIG. 17. In a particularly convenient system, the two additional blocks 80, 120 are configured so that a combined height of the two when stacked one on top of the other, is equal to the height H (0.5 H) of each of blocks 1, 50. It is noted that in this context, the combined height refers to the height dimension between the bottom most bearing surface of the lower block, and the upper most bearing surface of the upper block, and any additional height provided by the locator projection arrangement is disregarded. In an example assembly depicted, each block 80, 120 is one-half the height H of blocks 1, 50. Thus for the example depicted, the height H of block 80, FIG. 14, is 3 inches (76 mm).

Referring to FIG. 14, third block 80 is depicted in perspective view, and comprises a block body 80*b* having: a first, in the orientation depicted upper or top, bearing surface 84; and. a second, opposite, (in the depiction of FIG. 14 lower or bottom) bearing surface 85. The second (lower) bearing surface 85 is typically flat and unfeatured, although alternatives are possible. The first (upper) bearing surface 84 includes a central locator arrangement 88 (depicted as a locator projection arrangement)in the example shown surrounded by trough 88*t*, but which is typically otherwise flat and unfeatured. The block 80 includes opposite block sides 90, 91, each having an inset 93, 94 respectively therein, insets 93, 94, in the example shown, extending completely between bearing surfaces 84, 85. In the example block 1 depicted, locator (projection) arrangement 88 is a single projection 88*p*.

The insets 93, 94 each include a most recessed wall 97, and a pair of opposite inset sidewalls 98, 99.

Figure 15:
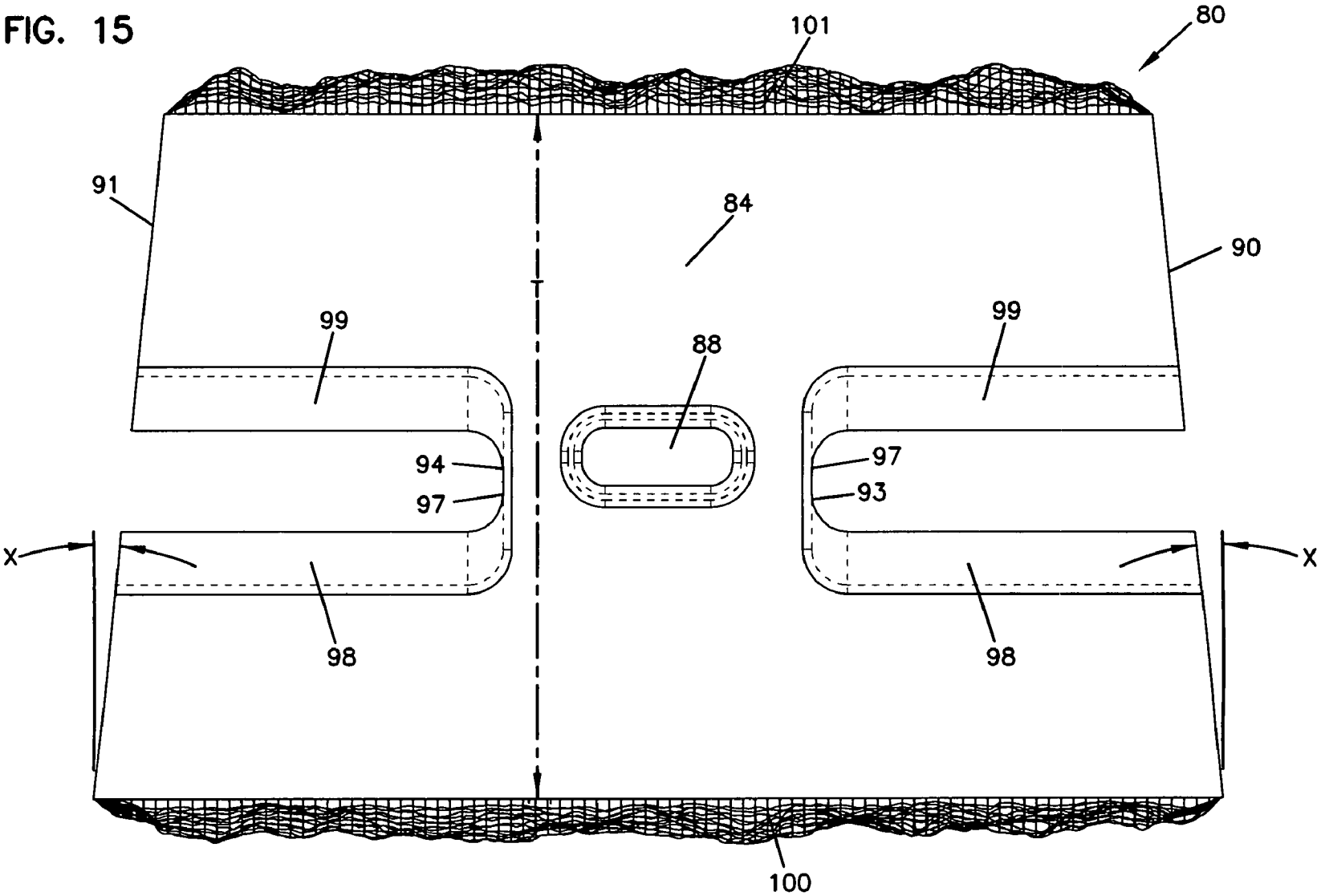
FIG. 15 is a schematic plan view of a first bearing surface of the third wall block of FIG. 14; the view of FIG. 14 being taken toward a first bearing surface having a locator projection arrangement thereon.

Block 80 includes a first, (in this instance decorative) exposure face 100 and a second, opposite, exposure face 101, typically also decorative, see FIG. 15, a top plan view. Still referring to FIG. 15, it is noted that the opposite sidewalls 90, 91 in the example block 80 depicted, converge toward one another in extension between the opposite sides 100, 101. Typically, each extends at an angle of convergence X, which is the same as the other; and, since it is to be used in a block set with blocks 1, 50, angle X (being the angle of convergence of the sidewalls of each block 1, 50, 80) should be the same as the others. In the example depicted sidewalls 90, 91 are generally planar, as is typical.

In the example depicted, first face 100 is the longer or wider face, and the second, opposite, face 101 is the shorter or narrower face. The insets 93, 94, are positioned and configured so that when block 80 is stacked on an identical block (or one of blocks 1, 50) in a half-overlap, on bond, orientation (head-to head) to form a section of set back wall, with the wider face 100 being the exposed face from which set back occurs, the amount of set back for block 80, relative to a below block, is proportional to the set back for the blocks 1, 50, in accord with the proportion of the height differences between block 80 and blocks 1, 50. Thus, for example in the described set, in which the height H (0.5 H) of block 80, is one-half the height H of blocks 1, 50, then insets in block 80 would be positioned for one-half the set back, with respect to an underneath block. In the example described in which the set back S2 defined by blocks 1, 50 is 0.42 inches (10.7 mm) the set back S1 defined by block 80, would be one-half of that (0.21 inches or 5.35 mm).

Example dimensions for the first face 100, for a set of blocks being described herein, is for example 3 inches (76 mm) high (H)×16 inches (406 mm) long (L), with the dimension of the opposite face 101 being 3 inches (76 mm) high×14 inches (356 mm) long. A depth of the block between the surfaces 100, 101 would typically be chosen to be the same as the blocks 1, 50 if used in a set with blocks 1, 50. Thus, for the example described, the distance T across the flat portion of bearing surface 84, in a direction between surfaces 100, 101, would be 9.5 inches (241 mm), with the decorative surfaces 100, 101, each, adding about 0.75 inch (19 mm) to this, for a total of 11 inches (279 mm). Such a block can be configured from dry cast concrete. The block would typically have a unit weight of about 30 pounds (13.6 kg), and would be usable to provide a set back wall section having a wall unit batter of 4°, whether used alone or in combination with one or more blocks 1, 50.

Figure 16:
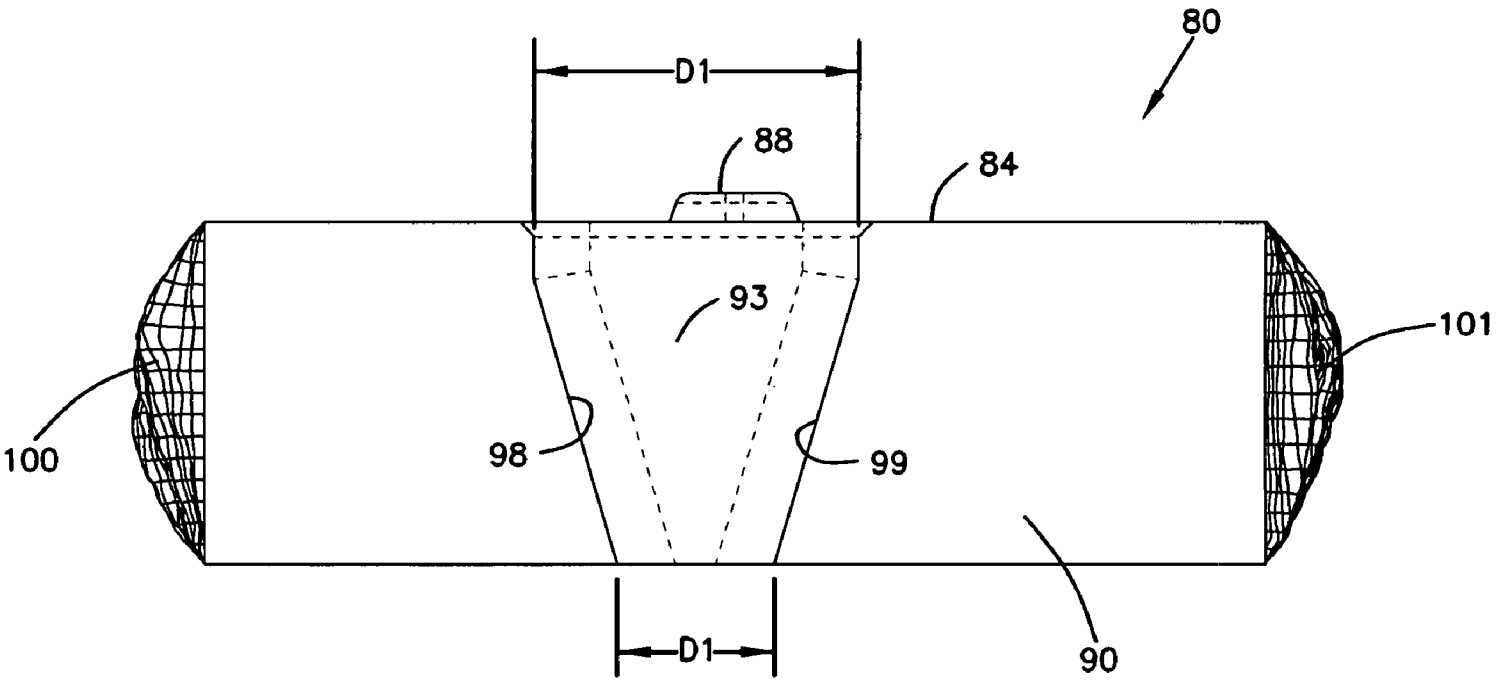
FIG. 16 is a schematic first side elevational view of the third wall block of FIG. 14.

The insets 93, 94, are typically configured generally analogously to the insets of blocks 1 and 50 and are typically configured as mirror images of one another. In FIG. 16, a side elevational view of block 80 is depicted, the view being generally taken toward side 90. It is noted that the view toward 91 would typically have the same features, but reversed. Thus. for example, insets 93, 94, where they intersect first bearing surface 84 have a wider dimension D1 thereacross than the dimension D2 across the insets 93, 94, where they intersect second bearing surface 85. The location of inset 93 and the dimension across the inset D2 adjacent second bearing surface 85 are typically chosen to provide for appropriate positioning of the inset wall 98 closest the exposure surface or face 100 for the desired set back as discussed above. Also D2 is typically chosen to provide for optional angling of blocks 80 relative to one another in set back courses, or in set back courses with blocks 1, 50. Typically dimension D2 will be chosen to be the same as dimension D2 of blocks 1 and 50.

On the other hand, where the insets 93, 94 intersect the first bearing surface 84, the dimension D1 thereacross is larger, and is typically chosen to be sufficiently large so that block 80 can be inverted and be set upon an identical block (or one of blocks 1 and 50), in half-overlap, on bond relationship, in adjacent courses to generate a vertical wall without set back, analogously. It is noted that for the particular example depicted, block 80 has generally the same perimeter definition, disregarding the inset location, at block 1. However the insets 93, 94 of block 80 are moved slightly toward first face 100, relative to block 1, to generate half the amount set backs since the block 80 is one-half as high (H).

The reason that block 80 is configured to provide for half the offset as blocks 1, 50, is that block 80 has one-half the dimension H (height). The object of course is to provide for the same total set back (i.e., wall unit batter) in any location across set back wall made with blocks 1, 50, 80.

Referring to FIG. 15, insets 93, 94 each have a most recessed wall 97, a first, front, inset sidewall 98 and an opposite, second, block, sidewall 99.

As with blocks 1 and 50, block 80 can be generally characterized as having recess arrangement and engagement surface arrangement, generally as characterized herein above. For the particular example block 80, as with blocks 1, 50, the recess arrangement and the engagement surface arrangement, together, are defined by the insets.

C. A Fourth Block Example, FIGS. 17, 18

Figure 17:
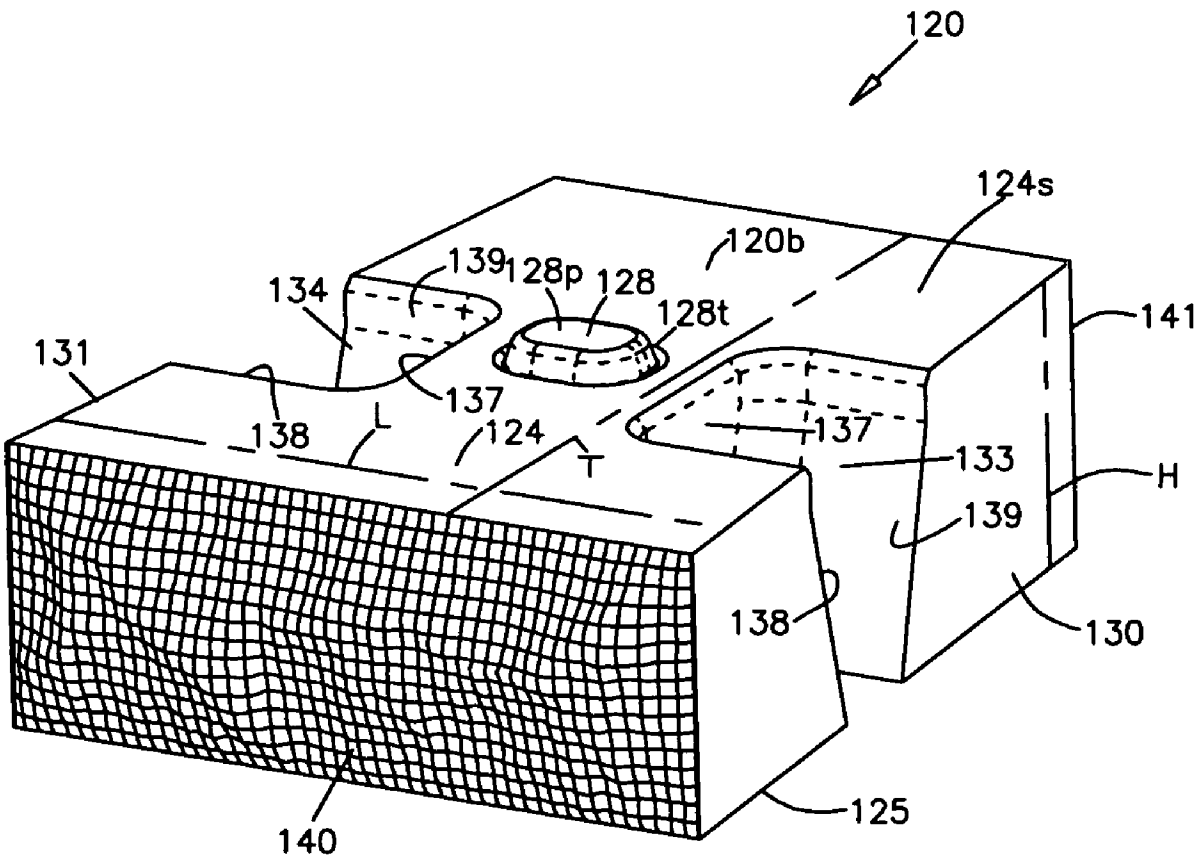
FIG. 17 is a schematic perspective view of an example fourth wall block usable to form a wall in accord with the present disclosure.
Figure 18:
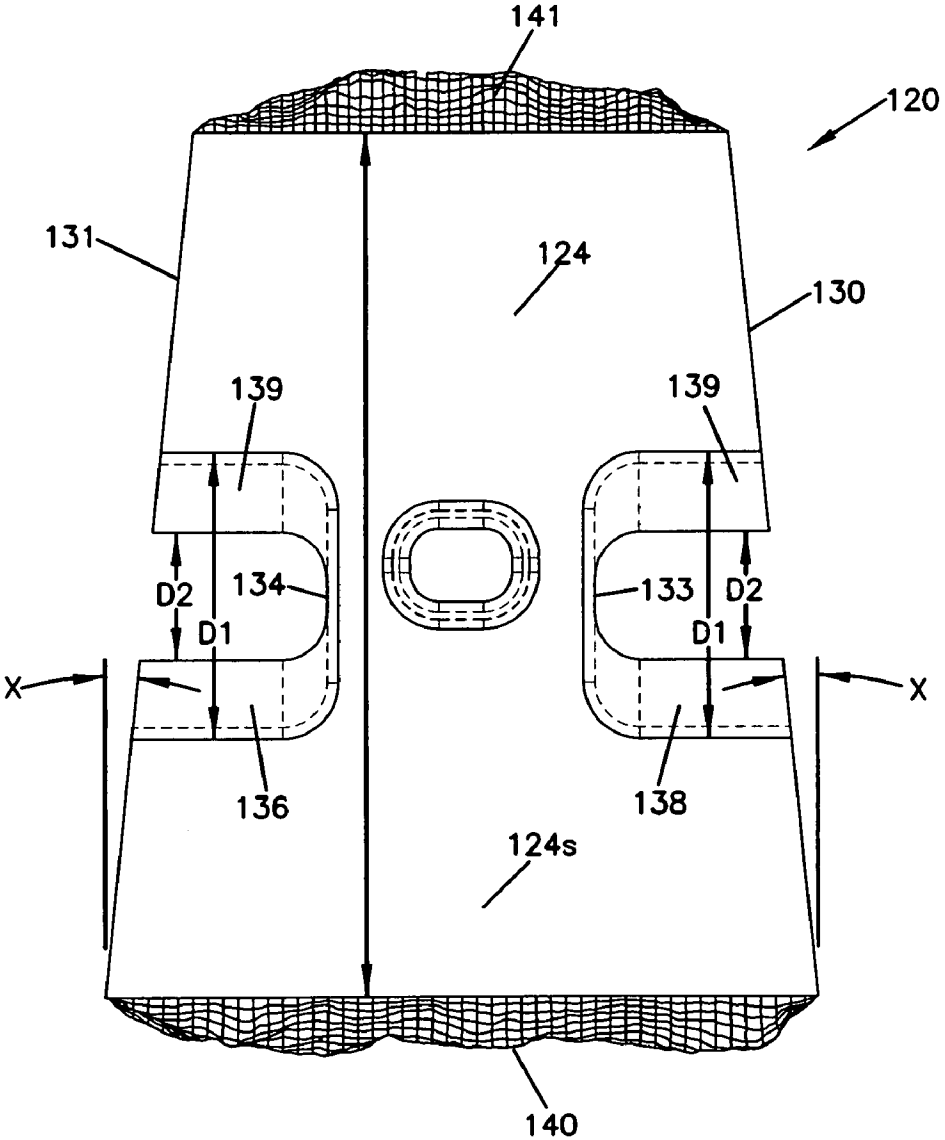
FIG. 18 is a schematic plan view of the fourth wall block of FIG. 17.

Attention is now directed to block 120, FIGS. 17, 18. Referring to FIG. 17, block 120 is depicted in perspective view. In general block 120 is to block 80, as block 50 is to block 1. Thus, block 80 will have half the (width) (i.e. the length of widest or longest face) as block 80, while having the same height H (distance between bearing surfaces) and depth T (distance between decorative surfaces) as block 80.

Referring to FIG. 17, block 120, then, comprises a block body 120*b* having first and second, opposite, bearing surfaces 124, 125. The first bearing surface 124, in the orientation of FIG. 17, is an upper or top bearing surface, and includes thereon a locator arrangement 128, in a particular locator projection arrangement which in the example depicted, in a single projection 128*p* surrounded by a trough 128*t*. The locator 128 generally projects upwardly from a remainder 124*s* of bearing surface 124, which is typically flat and unfeatured.

The second bearing surface 125 is typically flat and featureless, although alternatives are possible.

Block 120 includes opposite block sides 130, 131. The block sides 130, 131 for the example depicted, are typically flat and featureless except for the positioning of insets 133, 134, respectively therein, although alternatives are possible.

Insets 133, 134 are each generally defined by most a recessed wall 137 and opposite inset sidewalls 138, 139. Insets 133, 134 are typically positioned as mirror images of one another and in the example depicted, each extends completely between bearing surfaces 124, 125. In FIG. 18, a plan view of block 120 is provided, directed toward surface 124. Where the insets 133, 134 intersect the bearing surface 124, a distance between the walls 138, 139, defined at D1 is greater than an analogous distance D2 where the inset intersect the bearing surface 125. Selection of the dimensions D1 and D2 is generally based on the same principles as used for selecting analogous dimensions in blocks 1, 50 and 80, as previously discussed. Generally the dimensions D1 and D2 can be the same as in the other blocks 1, 50, 80.

Referring to FIG. 18, block 120 includes first and second, opposite, faces 140, 141, respectively, which can each be configured as decorative faces, see FIG. 18. Thus, surface 140 is a first, exposure face.

Typically the block sidewalls 130, 131 converge toward one another, in extension to face 140 toward face 141, the angle of convergence X of each typically being the same, as indicated at X. Preferably that angle of convergence X for the sidewalls 130, 131 is the same for block 120 as it is for blocks 1, 50 and 80 when the blocks are to be used as a set.

Example dimensions for face 140 are 3 inches (76 mm) high (H) by 8 inches (203 mm) long (L) and for face 141 is 3 inches (76 mm) high by 6 inches (152 mm) long. Thus, for the example block 140 depicted, a distance along bearing surface 124 (i.e., flat surface) between the faces 140, 141 is typically the same as blocks 1, 50, 80, i.e., is about 9.5 inches (241 mm), with the sculpted faces 140, 141 each adding an additional 0.75 inch (19 mm) causing a total wall depth of about 11 inches (279 mm) maximum. The block would weigh about 14 pounds (6.4 kg).

The perimeter definition of locator projection arrangement 128 would typically be analogous to the perimeter of locator projection arrangement 58, FIG. 12, i.e., locator projection arrangement 128 would have a similar width (direction between faces 140, 141) as an analogous dimension of locators 8, 58 and 88; and, would have a length (extension in direction parallel to direction between insets 133, 134) which is smaller than for block 120 (typically about half) and would be the same as locator (projection) 58, block 50.

Since block 120 is configured to have height dimension H (between bearing surfaces 124, 125) which is the same as block 80, but which is one-half of blocks 1 and 50, it will generally be configured so that when used in a set in accord with the descriptions herein, block 120 provides an offset in association with (above) or any of blocks 1, 50 and 80, which about one-half of set back defined by blocks 1 and 50 (and which is the same as block 80) i.e., for the example described 0.21 inches (5.35 mm).

When configured as described, block 120 can be used with other identical blocks to form a section set back wall, analogously to as previously described for the other blocks 1, 50, 80; and, it can be used to create a vertical wall section with identical blocks, again as previously described for blocks 1, 50, 80. Further block 120 can be used in cooperation with block 80, to analogously generate a section of a set back walls or section of a vertical wall.

Block 120 can be used in cooperation with a set of blocks comprising blocks 1, 50 and 80, to generate wall sections (either set back or vertical) with variations therein to allow for variability in decorative design of a wall, as described in the next section.

As generally characterized above for blocks 1, 50, 80, block 120 can be characterized as having a recess arrangement and an engagement surface arrangement as previously generally characterized. In the example block 120, the recess arrangement and the engagement surface arrangement are generally formed by the two insets 133, 134, although alternatives are possible.

IV. Example Wall Sections Using Blocks 1, 50, 80 and 120

As described previously, blocks 1, 50, 80 and 120, as described herein, can be used to form either set back walls or vertical walls, which are decorative. In this section, examples are provided to facilitate an understanding of this.

Figure 19:
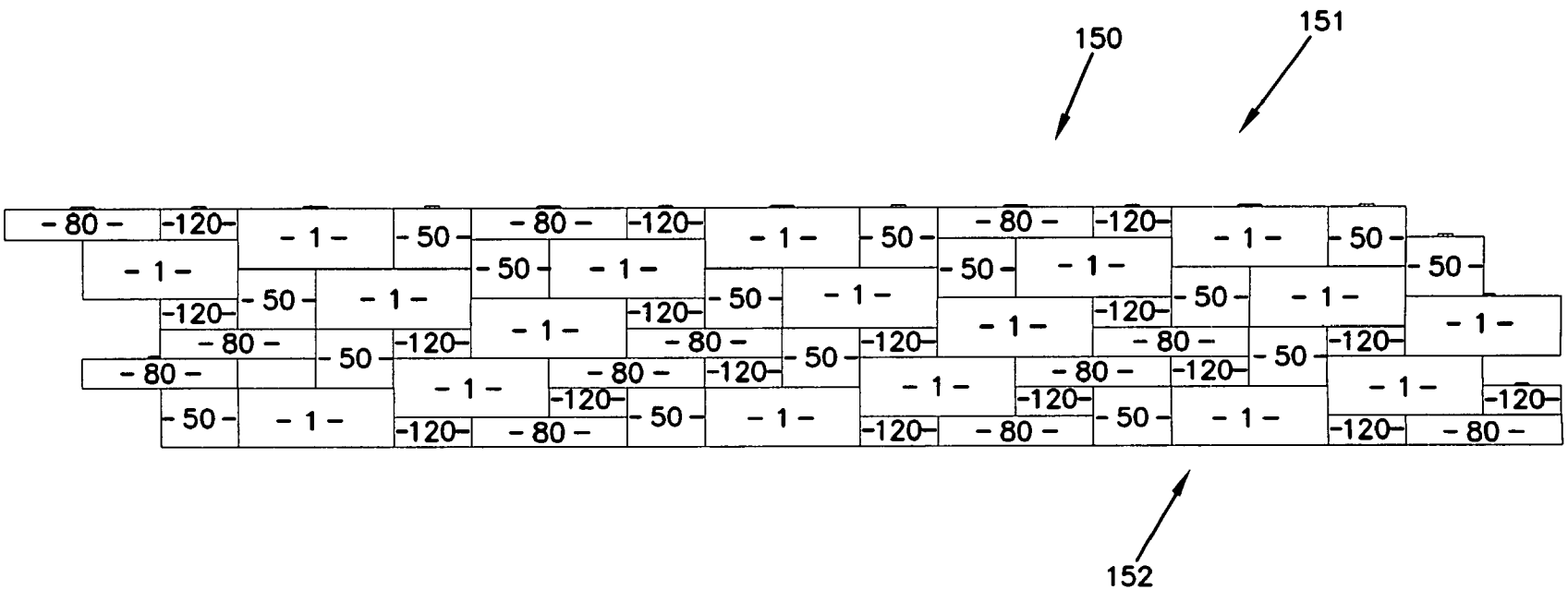
FIG. 19 is a schematic elevational view of an exposure face of a portion of a retaining wall with set back made with a kit of blocks including the blocks of FIGS. 1, 11, 14 and 17, according to the present disclosure.

Attention is first directed to FIG. 19. FIG. 19 is a schematic example portion 150 of a wall section 151 generated with set back, and made using blocks 1, 50, 80 and 120. In FIG. 19, wall section 150 is depicted with examples of the various blocks 1, 50, 80 and 120 so designated.

It can be seen that wall section 150 is configured to not have single horizontal joint extending completely thereacross. This is facilitated by configuring the wall in various sections as it is built vertically, with a mixture of blocks of first height (blocks 1, 50) and blocks of a second height (blocks 80, 120).

As each block is put in position, it is oriented with a set back relative to each lower block, with the second (lower) exposure face of each upper block engaging the first (upper) exposure face of each engaged lower block. The wall 151 defines an exposure face 152 in set back wall section 150, formed by the first exposure faces (20, 70, 100 and 140 respectively) of each of the blocks 1, 50, 80 and 120.

In wall section 150, set back between each half-high block (80, 120) and any block below it will be established as a first set back dimension S1; and, the set back between each full high block (1, 50) with respect to each block below it will be an established and defined set back distance S2; for the example depicted with SI being one-half S2 (S1=0.5×S2). This will ensure that along the length of the wall section 150, the same amount of total set back (or wall unit batter) will occur, without regard to the specific number of full high blocks (1, 50) and half high block (80, 120) used in the that particular portion of the wall section, as long as the same total height is reached.

Of course it will be understood that an analog construction can be used when an alternate set of blocks analogous to blocks 80, 20 (but which are not half-high blocks) are used. For example, if block 80 were two-thirds as high as blocks 1, 50, it would be configured for two-thirds set back, and with 120 one-third as high as blocks 120 would be configured for one-third set back. The particular block kit depicted (blocks 1, 50, 80, 120) is particularly convenient however with blocks 80, 120 being half high (distance between bearing surfaces) and with blocks 50, 120 being half wide (longer dimension of wider face) relative to analogous faces in blocks 1, 80).

Figure 20:
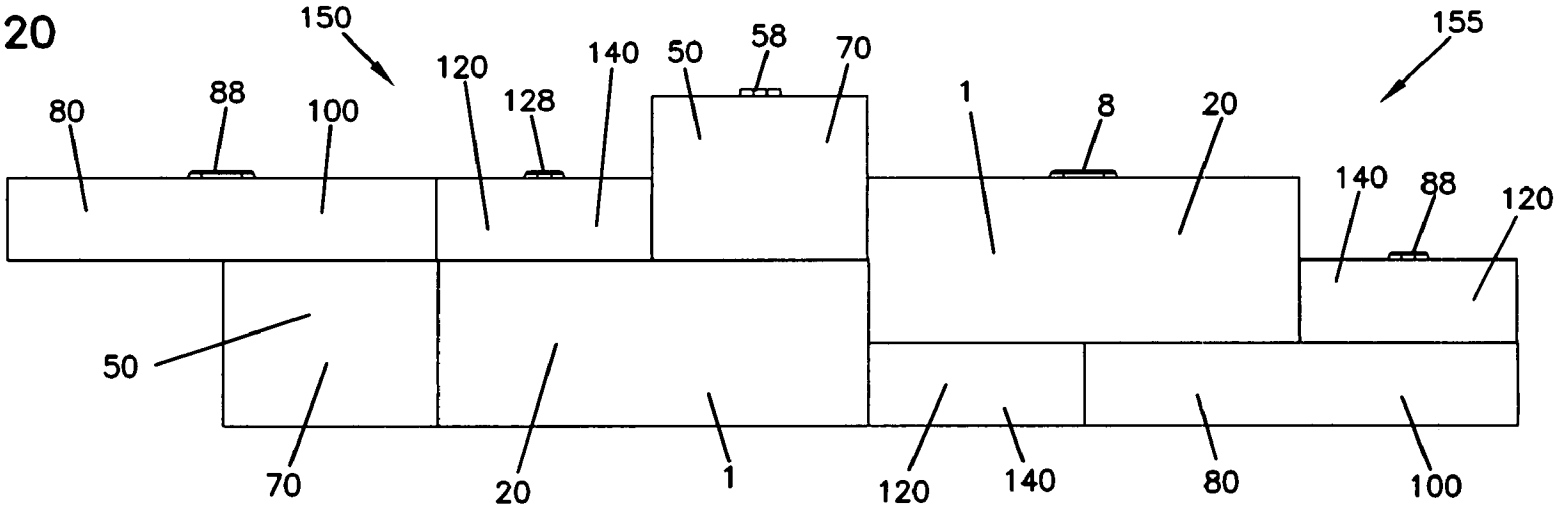
FIG. 20 is a schematic, enlarged elevational view of a selected section of the wall of FIG. 19.
Figure 21:
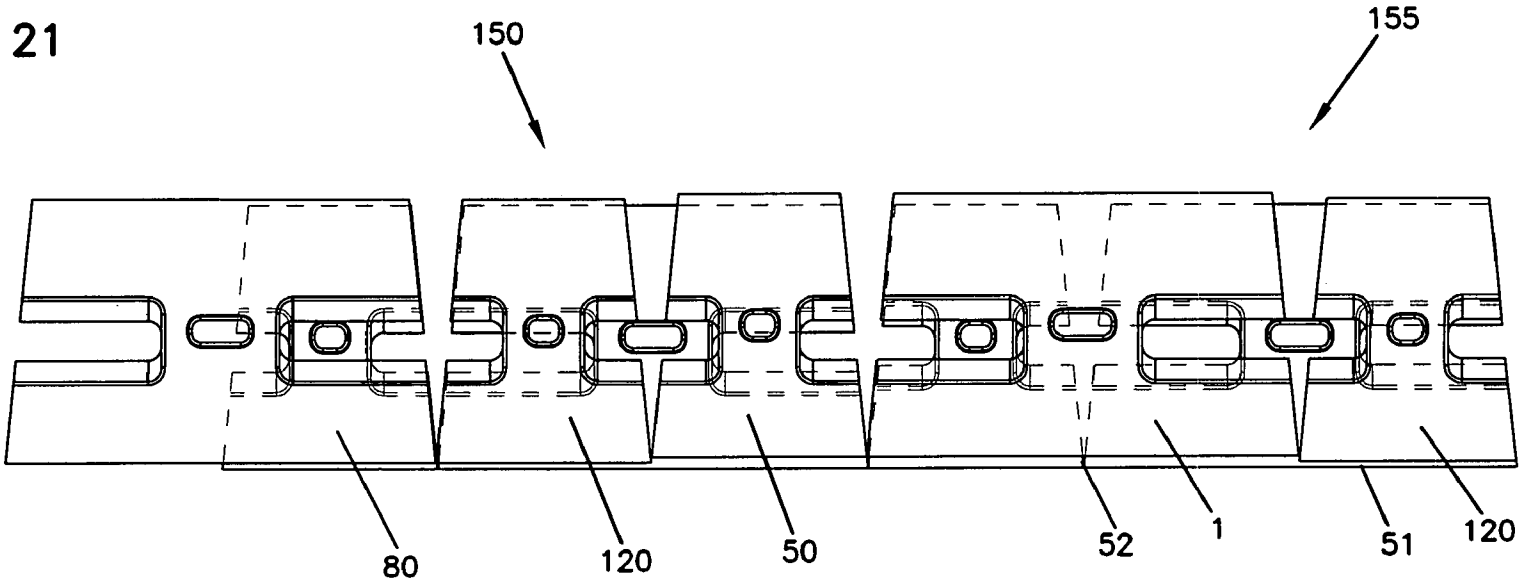
FIG. 21 is a schematic top plan view of the section of set back wall depicted in FIG. 20.

FIG. 20, a small section 155 of wall 150 (FIG. 19) is schematically depicted, which each of blocks 1, 50, 80, 120 used as shown. In FIG. 21, a top plan view of wall section 155 is provided. It can be seen that the taller blocks 1, 50 define twice the set back S2 as the set back S1 of shorter blocks (80, 120), with respect to underneath blocks.

Figure 22:
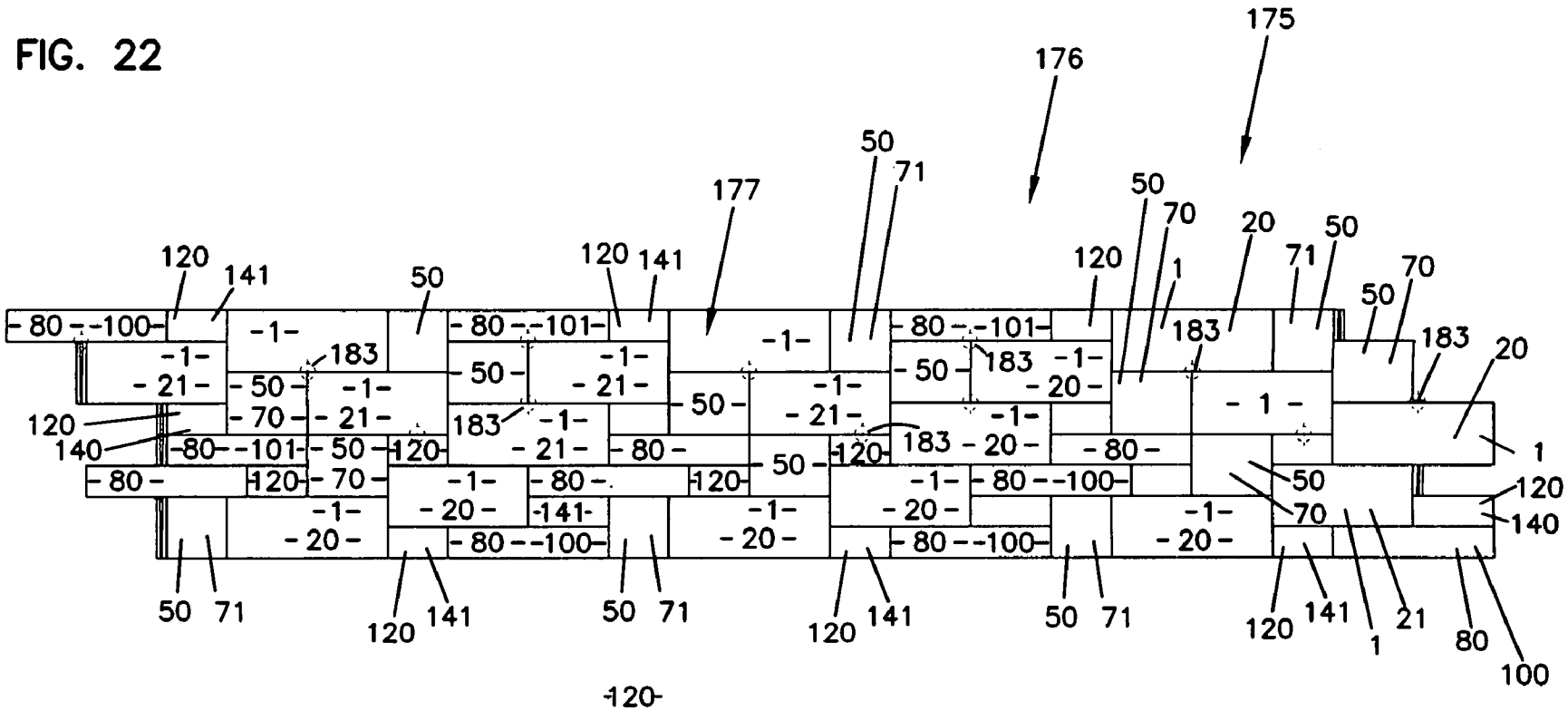
FIG. 22 is a schematic elevational view of one exposure face of a section of vertical wall without set back made using a kit of blocks including the blocks of FIGS. 1, 11, 14 and 17, according to the present disclosure.

In FIG. 22, a portion 175 of a vertical wall 176 is schematically depicted. Thus wall 176 has no set back. Further, when made with blocks 1, 50, 80 and 120 as identified, wall section 175 is provided with first and second decorative surfaces, the first decorative surface being indicated at 177 and a second decorative surface being at opposite surface 178, not viewable in FIG. 22.

Wall section 175, FIG. 22 is generally made with principles as described herein above. This will be understood further from a review of FIGS. 22-24.

Figure 23:
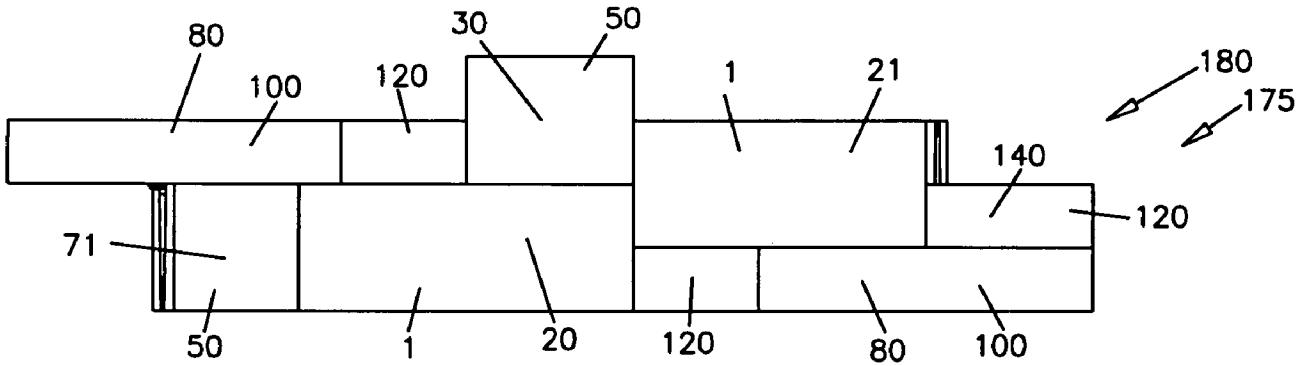
FIG. 23 is an enlarged schematic view of a selected wall section of the wall portion of FIG. 22.

In FIG. 23, a small section 180 of wall section 175 is depicted, formed from blocks 1, 50, 80 and 120, as shown. In wall section 180 laterally adjacent blocks are rotated 180° with respect to one another, with respect to which of two exposure faces (wider or narrower) is directed toward the viewer; i.e., adjacent blocks are head-to-toe laterally. For convenience in FIG. 23, the particular faces exposed of blocks 1, 50, 80 and 120 are as identified.

Figure 24:
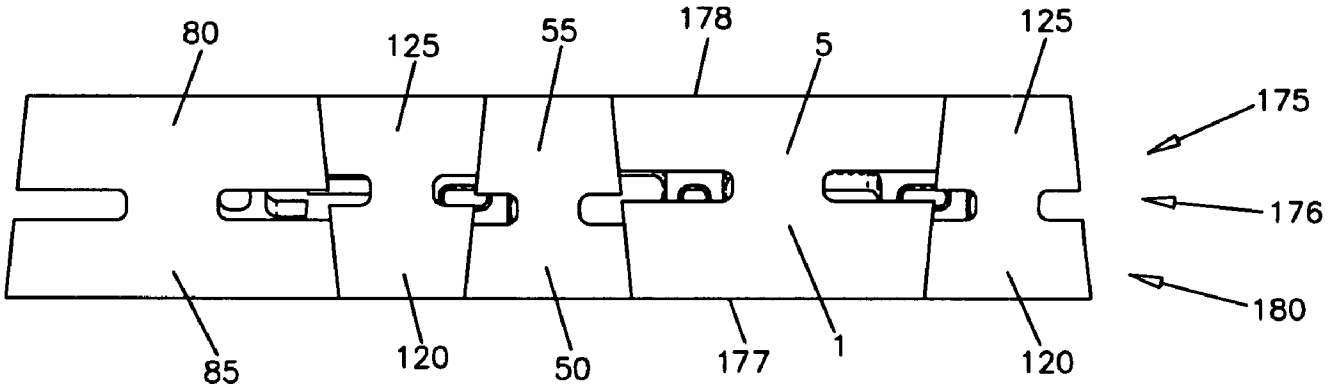
FIG. 24 is a schematic top plan view of the wall section of FIG. 23.

Attention is now directed to FIG. 24, a top plan view of wall section 180. Referring to FIG. 24, it can be seen that wall 176 will be a vertical wall (i.e., a wall without set back) having first and second, opposite, exposure faces 177, 178. Assuming that the blocks 1, 50, 80 and 120 are used as described herein above, the faces 177, 178 will be decorative, as they will be formed from the decorative faces of the various blocks. It is noted that in FIGS. 22-25, wall 175 is drawn schematically, and detail showing these sculpted or decorative is not provided.

In FIG. 24, various blocks 1, 50, 80, 120 are identified appropriately. It can be sent that laterally adjacent blocks are oriented "head-to-toe" as previously described. It will also be understood that vertically adjacent blocks are depicted inverted relative to one another.

Figure 25:
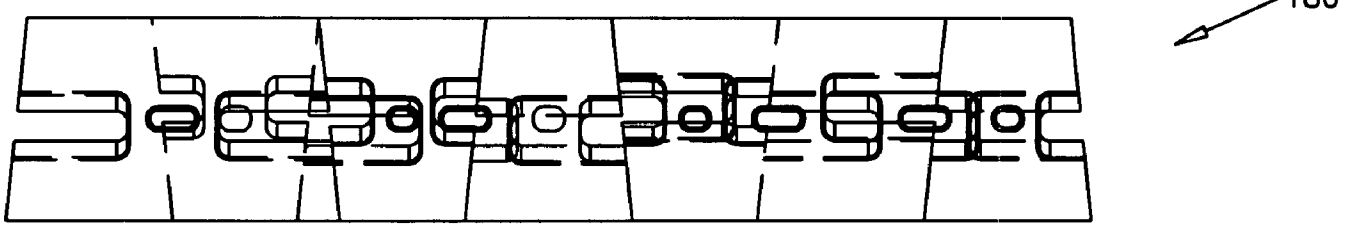
FIG. 25 is analogous to FIG. 24, with phantom lines showing selected hidden features.

FIG. 25 a view analogous to FIG. 24 is depicted, with hidden lines showing hidden, selected, features of the blocks.

Again, as described herein above, in a vertical wall or wall section made without set back, it is expected that a masonry glue would be positioned at joints between vertically adjacent blocks.

It is noted that with a precisely defined wall block set, any given wall design can be computer modeled and then be mimicked in the field. However, the blocks are configured for field assembly even without a preconceived or pre-designed block pattern. Thus, in the field, a variety of wall sections, without repeating block pattern sections readily discernible by the casual observer, can be conveniently made. It is noted that in some instances while laying the wall block, interference from locator arrangements (on one or both of the blocks) may occur. Should this occur, the interfering locator projection arrangement(s) can be chiseled off or otherwise removed as described herein above. In FIG. 22, phantom line locations 183 show where, for the particular wall section 175 depicted, the locator projection arrangement would typically have been removed.

It is noted that although the blocks 1, 50, 80 and 120 are particularly well configured to make curved sections in set back walls, but they are not as readily adapted for curved sections in vertical walls. However adjustments in angles of convergence of the block sides of various ones of the block can be made in the field, to cause a turning of a wall section, if desired.

V. Palleting (Cubing) of the Blocks

It is anticipated with the block set comprising blocks 1, 50, 80 and 120, convenient palleting arrangements can be made for shipment to the field, to facilitate assembly. Typically a pallet would only include either tall blocks (1, 50) or short blocks (80, 120). Typically within the tall block set, the same number of wide blocks (1) and narrow blocks (50) would be provided. Typically in the short block set the same would be true i.e., there would be an equal of number of wide blocks (80) and narrow blocks (120).

Typically a pallet of tall blocks (1, 50) would be configured with the same total height of stacked blocks, as the pallet of short blocks (80, 120). Thus the tall block pallet would have half as many blocks as the short block pallet.

This configuration or cubing pattern of the blocks on pallets provides for convenient ordering of pallets for making a wall section. For example, if the wall section is to be a set back wall, it would be convenient to order twice as many tall block pallets as small block pallets, in order to obtain an equal number of tall blocks and small blocks in the wall.

For a typical free-standing wall it would be convenient to order an equal number of tall block pallets as small block pallets, since each pallet will have the same block face area (exposure face area) as the other.

VI. Corners and Columns

In some instances it will be desirable to introduce corners or columns into the walls. A wide variety of such corners or columns can be implemented with blocks according to the present disclosure, including through addition of other blocks to facilitate the construction. Some examples are described herein.

A. Example Corners, FIGS. 33-36

Figure 33:
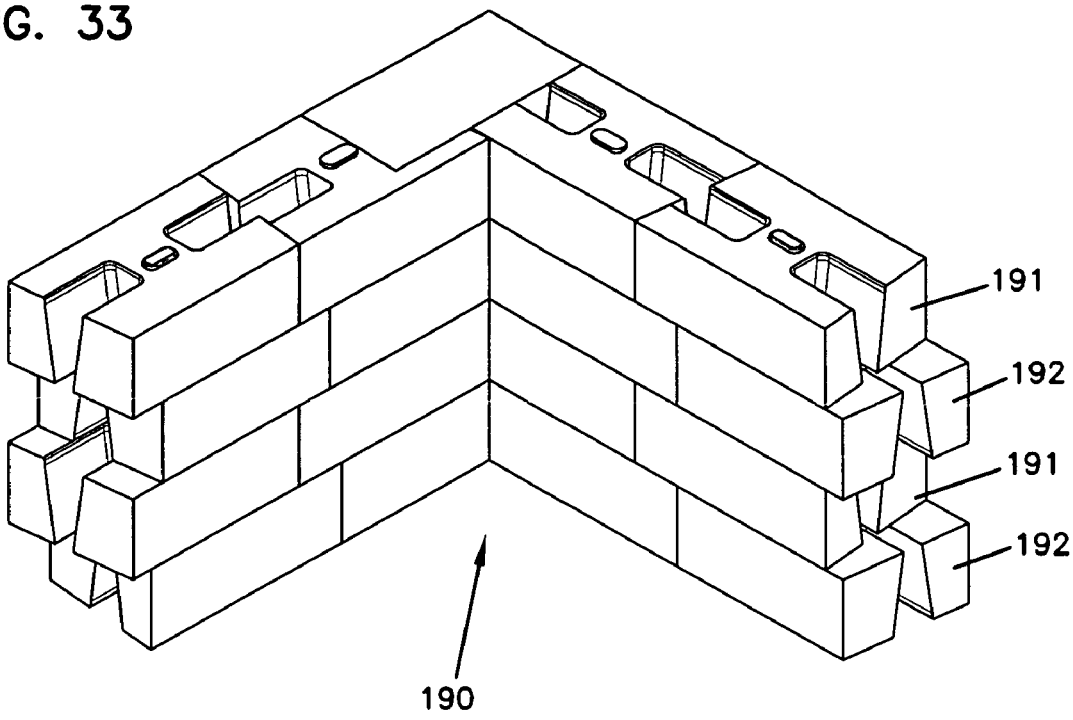
FIG. 33 is a schematic perspective view of an inside of a corner of a wall section made at least in part with blocks according to the present disclosure.
Figure 34:
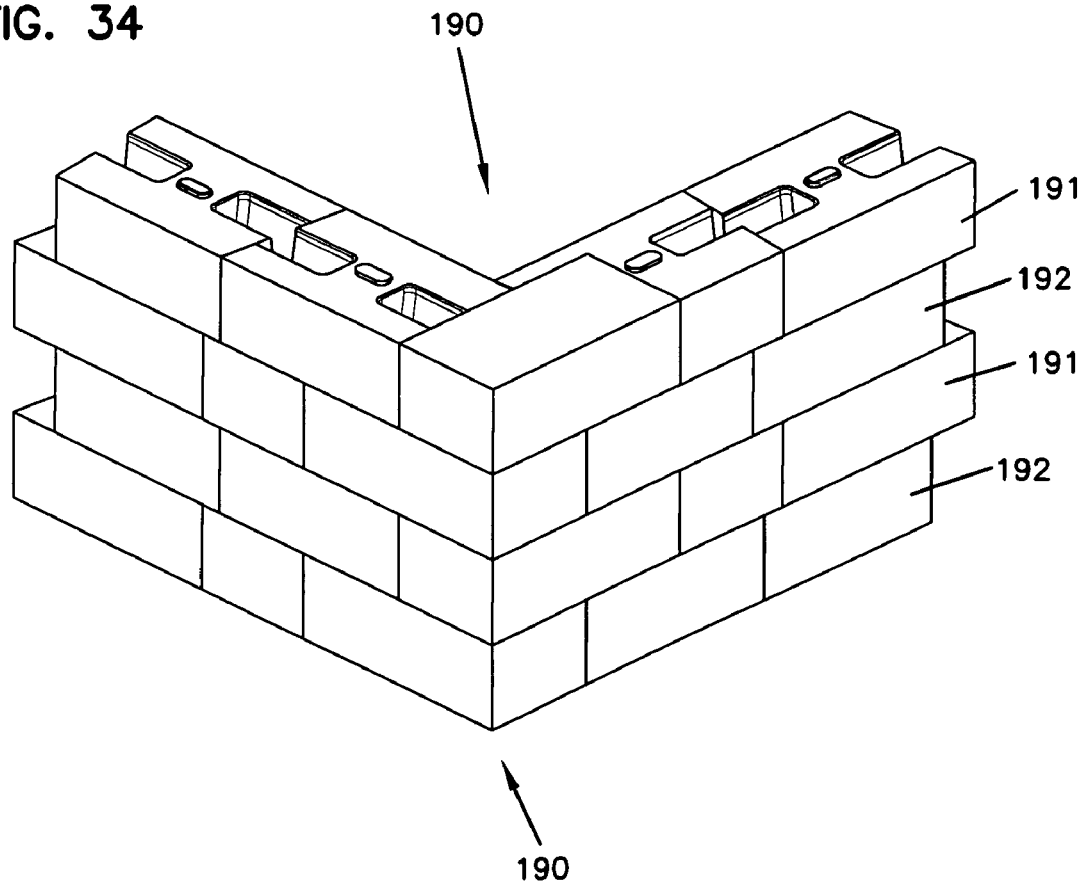
FIG. 34 is a perspective view toward an outside of the corner of FIG. 33.

Example corner constructions for a vertical or free-standing wall made with blocks according to the present disclosure are provided by FIGS. 33-36. In FIG. 33, an inside view of a corner 190 is depicted. In FIG. 34 an outside view of the same corner 190 is shown.

Figure 35:
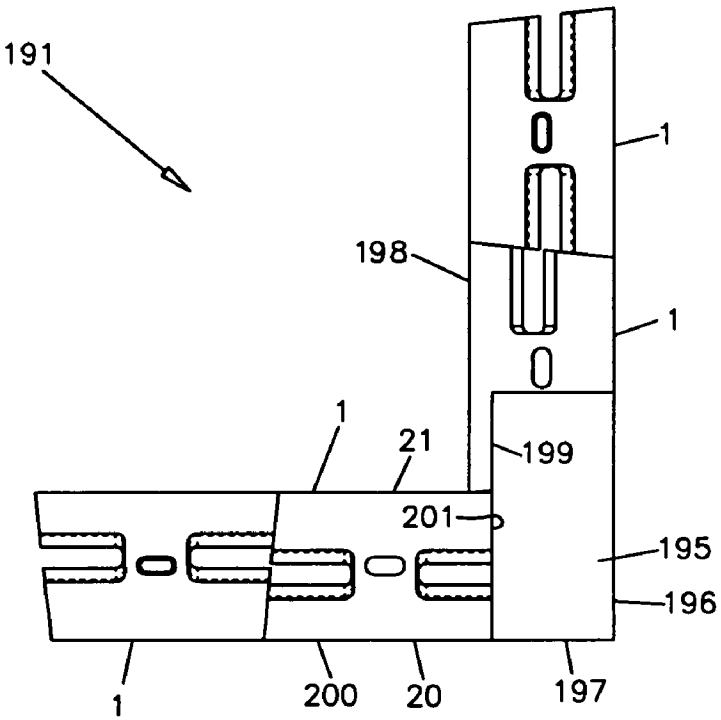
FIG. 35 is a schematic top plan view of one course of the corner of FIGS. 33 and 34.

In FIG. 35 a top plan view of a course 191 in corner 190 is depicted. The corner 190, in addition to being made using blocks analogous to block 1, as characterized above, also uses a corner block 195 which is an added block, for example a block 195 which is 6 inches (152 mm) high by 16 inches (406 mm) long (and for example 9.5 inches (241 mm) deep) and has no insets or locator projection arrangement. It is noted that block 195 would be used as a corner block. Thus, when used in a decorative wall, it would typically have two, adjacent decorative faces 196, 197.

It is noted that in course 191, block 198 corresponds to modified version of block 1, in particular with notch 199 has been cut out. It is also noted that block 200 corresponds to block 1 with edge 201 squared off with respect to surfaces 20, 21; i.e., block 200 is a field modified block 1.

Figure 36:
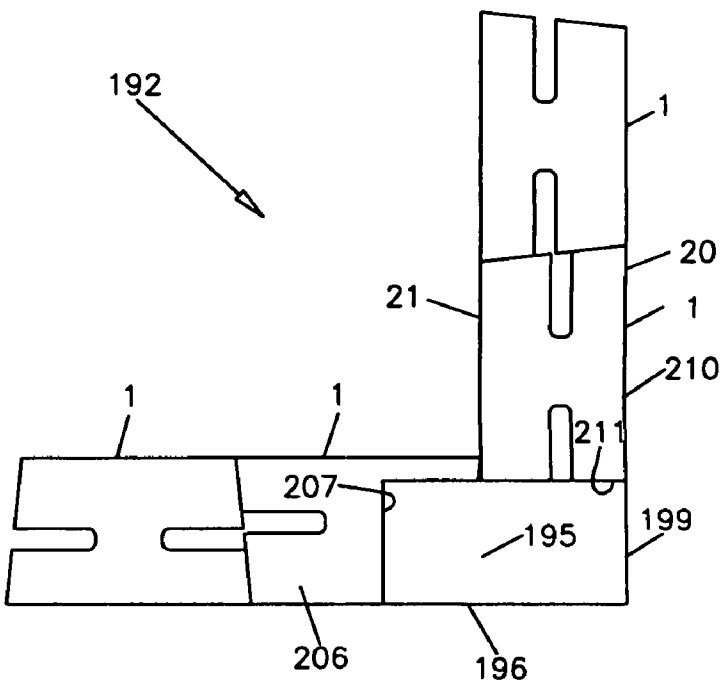
FIG. 36 is a schematic top plan view of a second course of the corner of FIGS. 33 and 34.

In FIG. 36, at 205 a second course 192 in corner 190 is depicted. Example usable blocks are identified. It is noted that block 206 has been modified from block 1, by cutting notch 207 therein. Also block 210 has been field modified at side 211 to have side 211 extend generally perpendicularly to surfaces 20, 21. These can be made as field modifications.

Using courses 191, 192 alternating with one another, corner 190, FIGS. 33 and 34 can be constructed. It is noted that blocks in each course would be inverted relative to adjacent courses, as previously described, using a masonry glue between layers.

It is noted that the types of cuts described can be made in field, with block cutters.

B. Example Columns; FIGS. 26-32

It is noted that a variety of columns can be configured by use of blocks in accord with the present description, in association with other blocks and modified blocks. These can include field modifications to previous blocks as desired or needed. Columns are sometimes desirable for example in free-standing walls either at ends, corners, or as selected in spaced locations.

In this section, example columns are depicted and described.

1. A First Example Column, FIGS. 26-28

Figure 28:
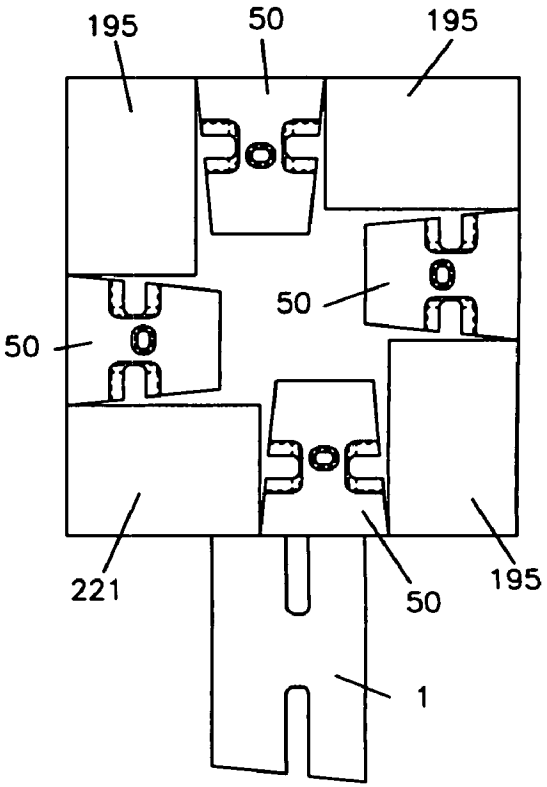
FIG. 28 is a schematic top plan view of a second block course for the column of FIG. 26.
Figure 27:
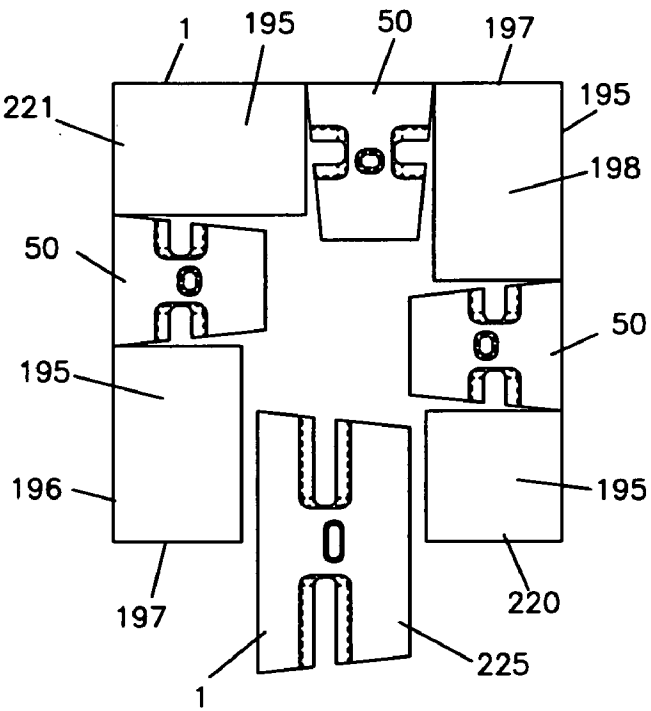
FIG. 27 is a schematic top plan view of a first block course for the column of FIG. 26.
Figure 26:
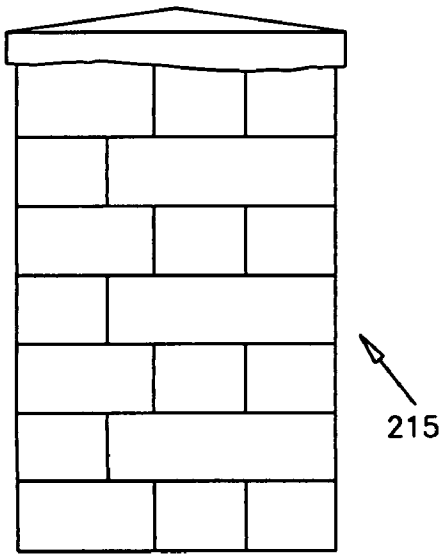
FIG. 26 is a schematic side elevational view of a column made with wall blocks.

FIG. 26 provides a schematic example of a first column 215. The column 215 can be made by alternating courses, as depicted in FIGS. 27 and 28. In general it is desirable that the column 215 be constructed with exposed wall faces comprising decorative faces.

Referring to FIG. 27, a first course 219 is depicted. Course 219 comprises, in part, blocks 50 oriented as shown, and corner blocks. It is noted that in FIG. 27, the course depicted includes a corner blocks 220, 221 which are field cut ones of blocks 155, FIGS. 35 and 36.

In FIG. 27 block 225 (comprising a block 1) shows where an adjoining wall engages the column 215.

In FIG. 28, a second course usable with the course of FIG. 27, to form the column in FIG. 26, is depicted. The blocks, depicted schematically, can be used as identified. With this configuration, the blocks do not necessarily have to be used inverted, in adjacent courses. However, in some locations it may either desirable to do so. It will typically be necessary to remove the locator projection arrangements in each course.

2. Second Example Column, FIGS. 29-30

Figure 30:
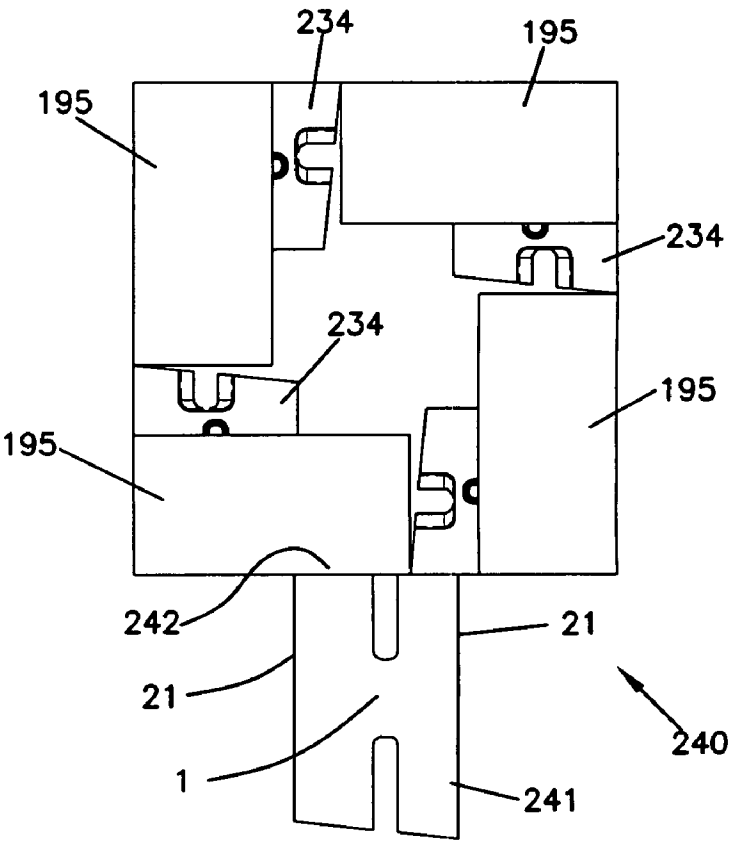
FIG. 30 is a schematic top plan view of a second course for the second, alternate, column.
Figure 29:
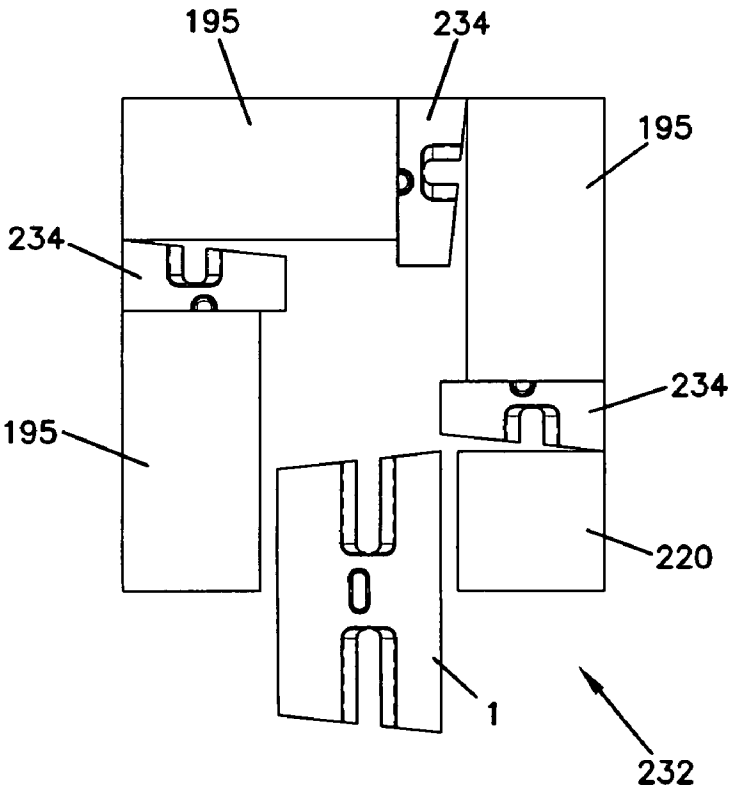
FIG. 29 is a schematic perspective view of a first block course for a second, alternate, column.

FIGS. 29 and 30 depict courses that can be used, alternately, to create yet another column configuration. Referring to FIG. 29, first, course 232 is depicted. It can be comprised of block 1, corner blocks 195, and cut block 220 as previously described, and intermittent blocks 234, each of which comprises half of a block 50, made by a field cutting blocks 50 in half.

Figure 31:
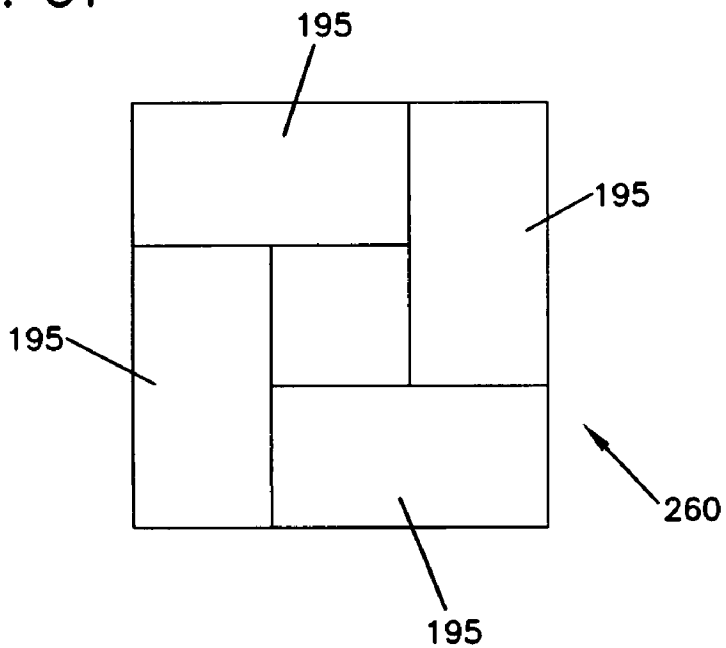
FIG. 31 is a schematic top plan view of a first course for a third column.

A second course depicted in FIG. 31, is shown at 240, made with similar blocks.

It is noted that the courses 232, 240 can be stacked alternating, to create a column. It is observed that it will typically be desirable to remove locator projection arrangements, to avoid interference. Also, in FIG. 30, side block 241 is depicted, comprising a block 1 modified at its side 242, to extend perpendicularly between surfaces 20, 21 This is to facilitate abutting of a wall section against the resulting column in this course.

3. Third Example Column, FIGS. 31-32

Figure 32:
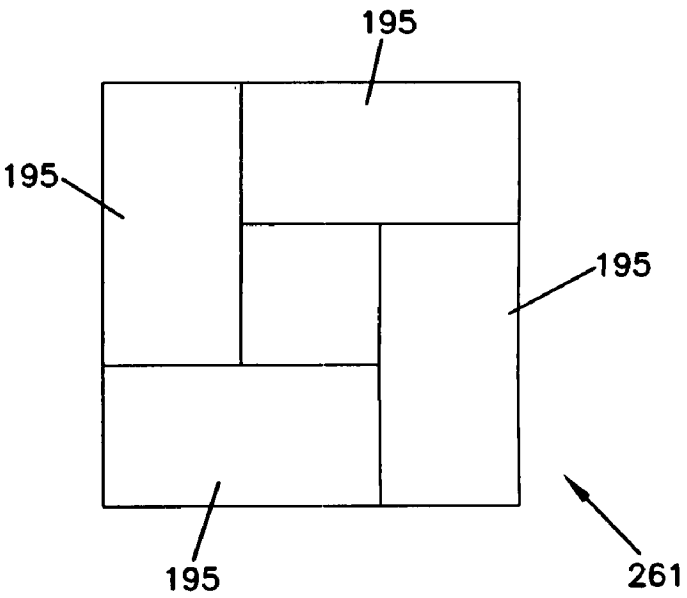
FIG. 32 is a schematic top plan view of a second course for the third column.

A third column can be made, for example, from courses 260, 261 depicted in FIGS. 31-32, alternating. The courses would comprise corner blocks 195 oriented as shown.

From the above examples of FIGS. 26-32, it will be understood that a variety of columns can be configured for use with free-standing walls (vertical walls) configured in accord with use of blocks as described herein. Of course a variety of alternate column arrangements can be configured.

VII. General Observations and Conclusions

According to a first aspect of the present disclosure, wall blocks are described with features appropriate for the wall blocks to be selectively used in a set back wall; and, for the same wall blocks to be selectively used in a vertical wall without set back. Herein the term "set back wall" is meant to refer to a wall having a section comprising wall blocks oriented with each block that is positioned above another block, to be in a position with a set back in a first direction, all set backs in the referenced wall section being in the same direction. Set back walls are configured, for example, to be used as retaining walls in landscaping. The set back for any given block in accord with characterizations of the present disclosure, can be at a selected value, S, and typically will be at a selected value S within the range 0.1 inch (2.5 mm) to 0.75 inch (19 mm), although alternate set backs are possible. A typical set back, as described herein, is configured to provide a wall batter (angle along the setback wall section from lowest portion to highest portion) of about 4°. A typical set back will be within the range of 0.15 inch (3.8 mm) to 0.5 inch (12.7 mm) inclusive.

The term "vertical wall" as described herein, is meant to describe a wall having a wall section in which wall blocks are positioned vertically above one another, to rise vertically without set back. A typical vertical wall is configured to be usable, for example, as a free-standing wall; i.e., a wall with opposite, exposed, faces or sides.

Herein when it said that a wall block is configured to be usable in each of the two types of walls, it is meant that the same wall block can be positioned in a wall with set back, or vertical wall, with the wall block having appropriate features for proper positioning therein.

Wall block configurations are described having features appropriate for the two uses described. The general configurations and features described, are usable in concrete wall block, whether made by wet cast or dry cast techniques. The specific features depicted in the drawings are particularly convenient for manufacture using dry cast concrete techniques.

With respect to use in a set back wall, specific block configurations are presented herewith, usable to form "mortarless" walls. Herein the term "mortarless wall" and variants thereof, is meant to refer to a wall that is constructed without mortar in horizontal joints or vertical joints, between blocks. Blocks usable in "mortarless walls" are sometimes referenced as "mortarless wall blocks."

Herein, when it said that the blocks are usable in a vertical wall, it is generally meant that the blocks can be positioned in such a wall, due to features thereof. Typically a masonry glue or bond will be used between vertically adjacent blocks in a vertical wall. It is noted that such walls will typically be prepared, however, without a visible mortar in either vertical or horizontal joints.

Features described herein for wall blocks can be used to provide for a set back wall or wall section with a decorative exposed face. Herein the term "exposed face," when used in connection with a set back wall, or setback wall section, is meant to refer to the face viewable to the observer of the wall, i.e., the exposed face (and not the face directed into the earth). Herein the term "decorative," in this context, is meant to refer to a face which has decorative features thereon, and is not simply plain, flat, concrete. In examples described herein, in order to provide a set back wall with a decorative exposure face, each wall block is provided with a first exposure face that is made decorative by being molded with various contouring to provide concave and convex portions therein. This contouring can comprise, for example, a design mimicking the appearance of natural stone, or a design depicting the appearance of natural stone pieces, for example laid together or mortared together.

It is noted that specific example wall blocks described herein, are usable to form free-standing vertical walls having opposite, exposure, faces each of which is decorative. To provide for this effect, specific example wall blocks are described which have first and second, opposite, faces, each of which is decorative.

It is noted that herein example wall blocks are depicted which have a decorative front exposure face having a depth of thickness which is generally greater than a setback generated by the use of that block above another block. This can help create an attractive contour face in a setback wall section constructed with the block.

Herein, in general terms, a wall block is described comprising a block body having first and second, opposite, bearing surfaces; first and second, opposite, blocks sides; a first, exposure, face and a second face opposite the first exposure face. In general, the bearing surfaces of a block, are those surfaces directed either upwardly or downwardly, when the block is positioned in a wall. Typically, the opposite bearing surfaces comprise surfaces which: bear downwardly upon other surfaces; or, on which load is positioned to bear downwardly, when the block is positioned in a wall or wall section. Typically the opposite bearing surfaces of wall block are configured to extend generally parallel to one another, and typically generally horizontally, when positioned in a wall or wall section.

The first and second, opposite, block sides, typically comprise block sides that extend perpendicularly to and between the bearing surfaces. Further, the block sides are generally those surfaces that extend between opposite front and rear faces of a wall, when a wall block is positioned in the wall.

For a given wall block, the first exposure face is generally a face of the block which extends: vertically between the bearing surfaces; laterally between the opposite block sides; and, which surface is configured to be exposed for view, whether the wall block used in either a vertical wall section or in a set back wall section. A second face, opposite the first exposure face, typically extends: parallel to the first exposure face; laterally between the first and second opposite block sides; and, typically vertically between the first and second opposite bearing surfaces. The second face can comprise an exposure face, when the block is used in a section of a vertical, free-standing, wall. However, the second face may not be an exposure face, for example when the block is used in a section of a set back wall, and the second face is directed toward earth retained by the wall.

Wall blocks as generally characterized herein comprise a block body having a locator projection arrangement on the first bearing surface. The locator projection arrangement typically comprises a projection arrangement positioned on the first bearing surface and directed upwardly. The locator projection arrangement can comprise one or more projections. Specific examples are depicted, in which the locator projection arrangement on each block comprises a single projection extending generally vertically, for example an amount within the range of 0.2 to 0.4 inches (5.1-10.2 mm), inclusive. Example projection arrangements depicted herein, are configured with slanted sides that taper inwardly, as the projection extends upwardly for example at an angle of 60-80°, for example 70°, inclusive, to the horizontal. Also example projection arrangements are described herein, which include a trough arrangement surrounding (and adjacent) the locator projection arrangement. The trough arrangement, which typically within the range of 0.2-0.1 inch (0.5-2.5 mm), inclusive is configured to facilitate removing the locator projection arrangement, if desired, from the block in the field. Typical field removal of a locator projection arrangement would comprise chiseling the locator projection arrangement off by positioning a chisel within the trough arrangement. This will facilitate removal of the locator projection arrangement so that any remaining artifact is beneath a remainder of the bearing surface, to advantage.

It is noted that the trough arrangements surrounding the locator projection arrangement can result in additional advantage. For example, during a block molding operation, in which a pressure plate is directed downwardly to form the first bearing surface and locator projection arrangement, when that pressure plate is configured to form both the locator projection arrangement and the trough arrangement, it has been observed that the locator projection arrangement forms more desirably, than when the trough is absent. Also, the trough arrangement surrounding the locator projection arrangement, provides for a desirable, crisp, surface portion operating a stop, when the locator projection arrangement is engaged by another block, to create setback.

It is noted that the advantageous combination of a locator projection arrangement and trough arrangement can be used with alternate block and those usable in both setback walls and vertical walls, to advantage.

It is noted that example wall blocks as described herein, also have a block body which includes a recess arrangement in the first bearing surface. A recess arrangement generally comprises one or more recesses in the bearing surface configured to receive, projecting therein, a locator projection arrangement on a vertically adjacent block, in certain situations, described below.

Also, in accord with general descriptions herein, each wall block includes an engagement surface arrangement. The engagement surface arrangement is generally configured for engagement with the locator projection arrangement of another block, to define a selected set back(s), when the wall block is used in a set back wall. The engagement surface arrangement, for example, can comprise the wall of a recess positioned in the second bearing surface.

In general terms, the locator projection arrangement, engagement surface arrangement and recess arrangement are selectively configured so that: when the wall block is oriented in either one of two head-to-head, half-overlap, on bond, set back relationships, engagements or orientations with a second, identical, block in a section of a mortarless set back wall, the locator projection arrangement of a first, lower, one of the wall blocks, when directed upwardly is engaged by the engagement surface arrangement of second, upper, one of the blocks, when that second wall block is also oriented with the locator projection arrangement directed upwardly, to define a selected set back S.

With respect to this, the term "head-to-head" when used herein, is meant to refer to an orientation: in which the first exposure face of each of the two blocks is directed in generally the same direction; and, in which each of the second face opposite the first exposure face, of each block, is directed in the same direction, i.e., a direction generally opposite the first face.

Herein when it said that the blocks are positioned in a "half-overlap, on bond" orientation, it is meant that when two blocks are positioned vertically adjacent one another in a set back, the upper block is generally positioned in partial overlap (i.e., half-overlap) laterally offset from the lower block, as is typical for use of a wall block in a section of a set back wall. The two possible set back relationships would be a first one in which the upper block is laterally shifted from the lower block either one-half block width to the left or one-half block width to the right; the second half-overlap position having the compliment.

When the term "set back" or variants thereof is used herein, it is meant that if a upper block is positioned shifted rearwardly from the lower block, a fixed distance or set back S is defined by engagement between the locator projection arrangement of the lower block and the engagement surface arrangement of the upper block. It is noted that when it is said that a wall block has features that provide for such a relationship when the wall block is oriented in engagement with an identical block, in a portion of set back wall, or by similar terms, it is not meant that when actually positioned in a wall, the block is necessarily in engagement with an identical block. All that is meant is that the block has features so that it can be adjacent an identical block, in a section of such a set back wall.

Herein when the term "identical" is used in reference to a block engaging with a similar block, the term "identical" is meant to refer to general features of shape, and not that one block cannot be discerned from the other block, by the human eye, upon examination of specific grain features and/or surface imperfections or variations. In addition, the decorative faces of each can be varied from one another.

It is also noted that within the block, the locator projection arrangement, engagement surface arrangement and recess arrangement are typically configured so that when the wall block is oriented in any one of four half-overlap, on bond, vertical relationships with a second, identical, inverted wall block in a section of a vertical wall without set back, with the first bearing surface of each directed toward the first bearing surface of the other, the locator projection arrangement of each one projects into the recess arrangement on the first bearing surface of the other; the four vertical relationships identified comprising: two head-to-head, half-overlap, on bond, relationships; and, two head-to-toe, half-overlap, on bond relationships.

Herein, in this context, the term "head-to-head" is meant to have the same meaning as characterized above for a set back wall, i.e., the blocks are oriented: with the first exposure face of each generally directed in the same direction; and, with the second face of each generally directed in the same direction, and opposite the first exposure faces. The two, half-overlap, on bond, relationships, are generally as characterized above, expect without set back. Thus, an upper block is positioned above and laterally offset the lower block, by about one-half block width, in one of two possible lateral directions.

The term "head-to-tail" in the context of this characterization, is meant to refer to two adjacent blocks oriented with the first exposure face of the one directed oppositely of the first exposure face of the other; and, with the second exposure face of the one directed oppositely of the second exposure face of the other.

It is noted that the characterization of the locator projection arrangement of each one projecting into the recess arrangement on the bearing surface of the other, means that the recess arrangement is configured to not interfere with the locator projection arrangement, when the blocks are oriented as described. More is not meant. Thus, it is not meant that the locator projection of one is completely received within the recess of the other; rather it is merely meant that the recess arrangement is configured to provide clearance as necessary, for the possible described engagement.

It is also noted that when a first wall block is described as having features such that it can be positioned with respect to an identical block in a portion of a vertical wall, it is not necessarily meant that when an actual vertical wall section is made, two identical blocks are so positioned. Rather, when the blocks include features so that they can be positioned as described, the blocks are advantageously featured for use in a vertical wall section without set back.

It is noted that the engagement surface arrangement and the recess arrangement together, can be defined by an inset arrangement; the inset arrangement typically comprising a first inset in the first sidewall and a second inset in the second sidewall; each of the first and second insets extending completely between the first and second, opposite, bearing surfaces. Examples of this are depicted.

Although alternatives are possible, the first and second insets, for the examples depicted, are configured and oriented as mirror images of one another. This is particularly convenient, for variability of the wall blocks in use.

In general, when the wall block body includes insets as characterized above, each inset has first and second, opposite, inset sidewalls, and for each inset a distance D1 between the first and second, opposite, inset sidewalls adjacent the first bearing surface is larger than a distance D2 between the first and second, opposite, inset sidewalls adjacent the second bearing surface. Typically, the insets are configured so that D1 is at least 1.7×D2, and often D1 is about 1.9-2.2×D2, inclusive.

Although a wall block can be configured so that the first and second opposite sides (sidewalls) are planar and extend generally parallel to one another in extension from the first face toward the second face, typically the first and second opposite block sidewalls are made planar and are oriented to converge toward in extension from the first face toward the second face. Advantages relating from this convergence the two sidewalls toward one another, concern: blocks being advantageously usable in a set back wall even in sections of curvature (for example convex or concave wall sections); and, positioning the wall blocks adjacent to one another, head-to-toe, in a vertical wall section.

Although alternatives are possible, for a typical wall block the first sidewall extends at an angle of convergence X which is the same as an angle of convergence X of the second sidewall; the angle of convergence X being an angle of general direction of the sidewall relative to a plane extending perpendicularly between the first and second faces. Although alternatives are possible, in typical applications, the angle of convergence X is a selected angle within the 3° to 12°, inclusive, for example 7.8°.

In general terms, the first exposure face can be characterized as having a height H and length L. The first bearing surface can be characterized as extending in a direction between the first and second exposure faces a distance T. The distance T when characterized herein, is generally meant to exclude any dimension in the block provided in the same direction, by the decorative first and second faces, when made with contouring. Thus, the dimension T is meant to be the dimension across a bearing surface, but not including decorative portions of the first and second faces when present. In an example block described herein, the height H is 6 inches (15.24 mm), the length L is 16 inches (406 mm); and, distance T is 9.5 inches (241 mm). Alternate blocks are described in which the height H is 3 inches (76.2 mm). Also alternates are described in which the length L is 8 inches (203 mm). Some blocks are described in which the height H is 3 inches (76.2 mm) and the length L is 8 inches (203 mm).

In a typical wall block set according to the present disclosure, each of the wall blocks has the same dimension T, even though variations with respect to height H and length L are used.

Herein, sets of wall blocks usable selectively to form a section of a set back wall and also usable selectively to form a section of a vertical wall are described. Such a set would typically comprise at least two wall blocks each of which is generally as configured above, but which differ from one another, at least with respect to one of the height H and the length L of the first exposure surface.

In one example set, a plurality of first wall blocks and a plurality of second wall blocks are included, the difference between the wall blocks generally relating to the dimension L of the first exposure face, the dimension L of one being one-half the dimension L of the other.

Also described herein is a set of wall blocks as described comprising first and second wall blocks as generally characterized herein, which differ from one another in height H of the first exposure face.

Also described herein are sets of wall blocks which include multiple wall blocks generally as characterized above, differing from one another with respect to at least one of: height H of the first exposure face; the length L of the first exposure face; and/or the amount of set back S as defined by that block, when positioned above and in set back relationship with at least one other block in the set. Some example configurations for such wall block sets are described.

It is also noted that herein wall sections are described, comprising the various blocks as characterized. Some methods of forming such wall sections are described.

It is noted that when blocks as described herein are characterized as positioned in a section of a vertical wall, they may be sometimes characterized as being in a first bearing surface-to-bearing surface engagement; or, in a second bearing surface-to-second bearing surface orientation or engagement. The term first bearing surface-to-first bearing surface engagement (relationship or orientation) in this context is meant that the vertically adjacent blocks are positioned when the first bearing surface of one is engaged by the first bearing surface of the other. When the term "second bearing surface-to-second bearing surface engagement" (relationship or orientation) is used, it is meant that the second bearing surface of one of two vertically adjacent is engaged by the second bearing surface of the other.

Also described herein are techniques for forming corners and columns, for use in association with wall sections made with blocks according to the present description.

Also described herein, are wall blocks provided with a first bearing surface having a locator projection arrangement thereon, surrounded by a trough. The wall block may include selected ones of the additional features characterized herein, if desired. The trough is typically configured to have a depth as described above. The trough can be configured to a circular radius, and thus be semi-circular cross-sectional configuration.

It is noted that there is no specific requirement that any given wall block, or wall section, comprise all of the features characterized herein, made with all of the techniques characterized herein, in order to obtain some benefit according to the present disclosure. From the descriptions it will be apparent that variability is optional, while accomplishing the objectives described. Further, there is no specific requirement that when actually used in a wall section, a block cannot be modified from the description contained herein, for example with respect to: removal of a locator projection arrangement; or, a field cut or notch provided the block to be appropriate to define a specific feature in a wall.

What is claimed:

1. A wall block comprising:

a block body having:

(a) first and second, opposite, bearing surfaces; first and second, opposite, block sides; a first, exposure, face; and, a second face opposite the first, exposure, face;

(b) a locator projection arrangement on the first bearing surface;

(c) a recess arrangement in the first bearing surface; and, (d) an engagement surface arrangement; the locator projection arrangement, engagement surface arrangement and recess arrangement being configured so that:

(i) when the wall block is oriented in either one of two head-to-head, half-overlap, on bond, setback relationships with a second, identical, block in a section of a mortarless set back wall, the locator projection arrangement of a first, lower, one of the wall blocks, when directed upwardly, is engaged by the engagement surface arrangement of a second, upper, one of the blocks, when the second block is oriented with the locator projection arrangement also directed upwardly, to define a selected set back; and, (ii) when the wall block is oriented below, and in any one of four half-overlap, on bond, vertical relationships, with a second, identical, inverted wall block in a section of a vertical wall without set back, with the first bearing surface of each directed toward the first bearing surface of the other, the locator projection arrangement of each one projects into the recess arrangement on the first bearing surface of the other; the four vertical relationships comprising: two head-to-head, half-overlap, on bond, relationships; and, two head-to-tail, half-overlap, on bond, relationships.

2. A wall block according to claim 1 wherein:

the first exposure face and the second face opposite the first exposure face are each molded, decorative, faces with contours defining convex and concave portions.

3. A wall block according to claim 2 wherein:

the engagement surface arrangement and the recess arrangement together comprise a first inset in the first sidewall and a second inset in the second wall;

each of the first and second insets extending completely between the first and second, opposite, bearing surfaces.

4. A wall block according to claim 3 wherein:

the first and second insets are configured and oriented as mirror images of one another.

5. A wall block according to claim 3 wherein:

(a) each inset has first and second, opposite, inset sidewalls; and, (b) for each inset a distance D1 between the first and second, opposite, inset sidewalls adjacent the first bearing surface is larger than a distance D2 between the first and second, opposite, inset sidewalls adjacent the second bearing surface.

6. A wall block according to claim 5 wherein:

D1 is at least 1.7×D2.

7. A wall block according to claim 5 wherein:

the first and second, opposite, block sides converge toward one another in extension from the first face toward the second face.

8. A wall block according to claim 7 wherein:

the first side extends at an angle of convergence X which is the same as an angle of convergence X of the second side.

9. A wall block according to claim 8 wherein:

(a) the angle of convergence X is a selected angle within the range of 3° to 12°, inclusive.

10. A wall block according to claim 9 wherein:

(a) the first exposure face has a height of 6 inches and a length of 16 inches; and, (b) the first bearing surface extends in a direction, between the first and second exposure faces, a distance of 9.5 inches.

11. A wall block according to claim 10 wherein:

the locator projection arrangement comprises a single projection.

12. A wall block according to claim 11 wherein:

the locator projection arrangement is surrounded by an adjacent trough in the first bearing surface.

13. A wall block according to claim 12 wherein:

the adjacent trough has a depth within the range of 0.2-0.1 inch, inclusive.

14. A wall block according to claim 1 wherein:

(a) the locator projection arrangement and the engagement surface arrangement are configured to define a selected setback S, when the wall block is oriented above a second identical block, in a half overlap, on bond, setback relationship, of a selected value within the range of 0.1 to 0.7 inch, inclusive.

15. A wall block according to claim 1 wherein:

the engagement surface arrangement and the recess arrangement together comprise a first inset in the first sidewall and a second inset in the second wall;

each of the first and second insets extending completely between the first and second, opposite, bearing surfaces.

16. A wall block according to claim 1 wherein:

the locator projection arrangement is a single projection surrounded by an adjacent trough in the first bearing surface.

17. A wall block according to claim 12 wherein:

the adjacent trough has a depth within the range of 0.2-0.1 inch, inclusive.

18. A set of wall blocks usable selectively to form a section of a setback wall and also usable selectively to form a section of a vertical wall; the set of wall blocks comprising:

(a) a plurality of first wall blocks each comprising a first block body having: first and second, opposite, bearing surfaces; first and second, opposite, block sides; a first, exposure, face; and, a second face opposite the first exposure face; the first block body further including:

(i) a locator projection arrangement on the first bearing surface;

(ii) a recess arrangement in the first bearing surface; and, (iii) an engagement surface arrangement; the locator projection arrangement, engagement surface arrangement and recess arrangement being configured so that:

(A) when the first wall block is oriented in either one of two head-to-head, half-overlap, on bond, setback relationships with an identical, block in a section of a mortarless set back wall, the locator projection arrangement of a lower one of the blocks, when directed upwardly, is engaged by the engagement surface arrangement of an upper one of the blocks, when the upper block is oriented with the locator projection arrangement also directed upwardly, to define a selected set back; and, (B) when the first wall block is oriented below, and in any one of four half-overlap, on bond, vertical relationships, with an identical, inverted wall block in a section of a vertical wall without set back, with the first bearing surface of each directed in the same direction as the first bearing surface of the other, the locator projection arrangement of each projects into the recess arrangement on the first bearing surface of the other; the four vertical relationships comprising: two head-to-head, half-overlap, on bond, relationships; and, two head-to-tail, half-overlap, on bond, relationships; and, (b) a plurality of second wall blocks each of different size than the first wall blocks and comprising a second block body having: first and second, opposite, bearing surfaces; first and second, opposite, block sides; a first, exposure, face; and, a second face opposite the first, exposure, face; the second block body further including:

(i) a locator projection arrangement on the first bearing surface;

(ii) a recess arrangement in the first bearing surface; and, (iii) an engagement surface arrangement; the locator projection arrangement, engagement surface arrangement and recess arrangement being configured so that:

(A) when the second wall block is oriented in either one of two head-to-head, half-overlap, on bond, setback relationships with another, identical, block in a section of a mortarless set back wall, the locator projection arrangement of a lower one of the wall blocks, when directed upwardly, is engaged by the engagement surface arrangement of an upper one of the second wall blocks, when the upper wall block is oriented with the locator projection arrangement also directed upwardly, to define a selected set back; and, (B) when the second wall block is oriented below, and in any one of four half-overlap, on bond, vertical relationships, with an identical, inverted, wall block in a section of a vertical wall without set back, with the first bearing surface of each directed toward the first bearing surface of the other, the locator projection arrangement of each projects into the recess arrangement on the first bearing surface of the other; the four vertical relationships comprising: two head-to-head, half-overlap, on bond relationships; and, two head-to-tail, half-overlap, on bond relationships;

(c) each first wall block and each second wall block each being configured to provide the same setback S2, when oriented in a section of a setback wall with each one of:

(i) one of the first wall blocks above and in setback engagement orientation with an identical first wall block with each block oriented with the first bearing surface directed the same direction;

(ii) one of the second wall blocks above and in set back engagement with an identical second wall block; with each block oriented with the first bearing surface directed in the same direction;

(iii) one of the first wall blocks above and in set back engagement with one of the second wall blocks with each block oriented with first bearing surface directed in the same direction; and, (iv) one of the second wall blocks above and in set back engagement with one of the first wall blocks with each block oriented with the first bearing surface directed in the same direction.

19. A set of wall blocks according to claim 18 wherein:

(a) the first and second sides of each first wall block converge toward one another in extension from the first face toward the second face, each at a same angle of convergence X; and, (b) the first and second sides of each second wall block converge toward one another in extension from the first face toward the second face each at a same angle of convergence X; and, (c) the angle of convergence X for each of the first and second wall blocks is the same.

20. A set of wall blocks according to claim 19 wherein:

the angle of convergence X is a selected angle within the range of 3° to 12°, inclusive.

21. A set of wall blocks according to claim 20 wherein:

(a) in each first wall block, the first exposure face and the second face, opposite the first exposure face, are each molded, decorative, faces with contours defining convex and concave portions; and, (b) in each second wall block, the first exposure face and the second face, opposite the first exposure face, are each molded, decorative, faces with contours defining convex and concave portions.

22. A set of wall blocks according to claim 21 wherein:

(a) in each first wall block, the engagement surface arrangement and recess arrangement together comprise a first inset in the first sidewall and a second inset in the second wall; each of the first and second insets extending completely between the first and second, opposite, bearing surfaces; and, (b) in each second wall block, the engagement surface arrangement and recess arrangement together comprise a first inset in the first sidewall and a second inset in the second wall; each of the first and second insets extending completely between the first and second, opposite, bearing surfaces.

23. A set of wall blocks according to claim 22 wherein:

(a) in each first wall block, the first exposure face has a height H and a length L; and, the first bearing surface extends in a direction, between the first and second exposure faces, a distance T; and, (b) in each second wall block, the first exposure face has the same height H; a length of one-half L; and, the first bearing surface extends in a direction, between the first and second exposure faces, the same distance T.

24. A set of wall blocks according to claim 18 including:

(a) a plurality of third wall blocks each of a different size from the first and second wall blocks and each comprising a third block body having: first and second, opposite, bearing surfaces; first and second, opposite, block sides; a first, exposure, face; and, a second face opposite the first exposure face; the third block body further including:

(i) a locator projection arrangement on the first bearing surface;

(ii) a recess arrangement in the first bearing surface; and, (iii) an engagement surface arrangement; the locator projection arrangement, engagement surface arrangement and recess arrangement being configured so that:

(A) when one of the third wall blocks is oriented in either one of two head-to-head, half-overlap, on bond, setback relationships with an identical block in a section of a mortarless set back wall, the locator projection arrangement of a lower one of the third blocks, when directed upwardly, is engaged by the engagement surface arrangement of an upper one of the third blocks, when the upper block is oriented with the locator projection arrangement also directed upwardly, to define a selected set back; and, (B) when one of the third wall blocks is oriented below, and in any one of four half-overlap, on bond, vertical relationships, with an identical, inverted, third wall block in a section of a vertical wall without set back, with the first bearing surface of each directed toward the first bearing surface of the other, the locator projection arrangement of each projects into the recess arrangement on the first bearing surface of the other; the four vertical relationships comprising: two head-to-head, half-overlap relationships; and, two head-to-tail, half-overlap relationships; and, (b) a plurality of fourth wall blocks each of a different size from the first, second and third wall blocks and comprising a fourth block body having: first and second, opposite, bearing surfaces; first and second, opposite, block sides; a first, exposure, face; and, a second face opposite the first exposure face; the fourth block body further including:

(i) a locator projection arrangement on the first bearing surface;

(ii) a recess arrangement in the first bearing surface; and, (iii) an engagement surface arrangement; the locator projection arrangement, engagement surface arrangement and recess arrangement being configured so that:

(A) when one of the fourth wall blocks is oriented in either one of two head-to-head, half-overlap, on bond, setback relationships with an identical fourth block in a section of a mortarless set back wall, the locator projection arrangement of a lower one of the fourth wall blocks, when directed upwardly, is engaged by the engagement surface arrangement of an upper one of the fourth wall blocks, when the second block is oriented with the locator projection arrangement also directed upwardly, to define a selected set back; and, (B) when one of the fourth wall blocks is oriented below, and in any one of four half-overlap, on bond, vertical relationships, with an identical, inverted fourth wall block in a section of a vertical wall without set back, with the first bearing surface of each directed toward the first bearing surface of the other, the locator projection arrangement of each projects into the recess arrangement on the first bearing surface of the other; the four vertical relationships comprising: two head-to-head, half-overlap, relationships; and, two head-to-tail, half-overlap, relationships;

(c) each third wall block and each fourth wall block being configured to provide the same set back S1, when oriented in a section of a set back wall with each of:

(i) one of the third wall blocks above and in set back engagement with an identical third wall block; with each block oriented with the first bearing surface directed in the same direction;

(ii) one of the fourth wall blocks above and in set back engagement with an identical fourth wall block; with each block oriented with the first bearing surface direction in the same direction;

(iii) one of the third wall blocks above and in set back engagement with one of the fourth wall blocks with each block oriented with first bearing surface directed in the same direction;

(iv) one of the fourth blocks above and in set back engagement with one of the first blocks with each block oriented with the first bearing surface directed in the same direction;

(v) one of the third wall blocks oriented above, and in set back engagement with one of the first wall blocks;

(vi) one of the third wall blocks oriented above, and in set back engagement with one of the second wall blocks;

(vii) one of the fourth wall blocks oriented above, and in set back engagement with one of the first wall blocks; and, (viii) one of the fourth wall blocks oriented above and in set back engagement with one of the second wall blocks.

25. A set of wall blocks according to claim 24 wherein:

the first exposure face and the second face opposite the first exposure face, of each block, are each molded, decorative, faces with contours defining convex and concave portions.

26. A set of wall blocks according to claim 24 wherein:

the sidewalls of each of the first, second, third and fourth blocks extend at the same angle of convergence X.

27. A set of wall blocks according to claim 26 wherein:

(a) in each first wall block, the engagement surface arrangement and recess arrangement together comprise a first inset in the first sidewall and a second inset in the second sidewall; each of the first and second insets extending completely between the first and second, opposite, bearing surfaces so that the insets also define the recess arrangement;

(b) in each second wall block, the engagement surface arrangement and recess arrangement together comprise a first inset in the first sidewall and a second inset in the second sidewall; each of the first and second insets extending completely between the first and second, opposite, bearing surfaces so that the insets also define the recess arrangement;

(c) in each third wall block, the engagement surface arrangement and recess arrangement together comprise a first inset in the first sidewall and a second inset in the second sidewall; each of the first and second insets extending completely between the first and second, opposite, bearing surfaces so that the insets also define the recess arrangement; and, (d) in each fourth wall block, the engagement surface arrangement and recess arrangement together comprise a first inset in the first sidewall and a second inset in the second sidewall; each of the first and second insets extending completely between the first and second, opposite, bearing surfaces so that the insets also define the recess arrangement.

28. A set of wall blocks according to claim 24 wherein:

(a) in each first wall block, the first exposure face has a height of H and a length of L; and, the first bearing surface extends in a direction, between the first and second exposure faces, a distance of T;

(b) in each second wall block, the first exposure face has a height of H and a length of one-half L; and, the first bearing surface extends in a direction, between the first and second exposure faces, a distance of T;

(c) in each third wall block, the first exposure face has a height of one-half H and a length of L; and, the first bearing surface extends in a direction, between the first and second exposure faces, a distance of T; and, (d) in each fourth wall block, the first exposure face has a height of one-half H and a length of one-half L; and, the first bearing surface extends in a direction, between the first and second exposure faces, a distance of T.

29. A set of wall blocks according to claim 28 wherein:

(a) H is 6 inches;

(b) L is 16 inches; and, (c) T is 10 inches.

30. A multi-block section of a set back wall comprising first and second wall blocks configured according to the set of claim 18 oriented with the first bearing surface of each block directed upwardly.

31. A multi-block section of a set back wall comprising first, second, third and fourth wall blocks configured according to the set of claim 24 oriented with the first bearing surface of each block directed upwardly.

32. A multi-block section of a vertical wall comprising first and second wall blocks configured according to the set of claim 20 oriented:

(a) with horizontally adjacent blocks positioned head-to-toe with the first face of one adjacent the second face of another; and, (b) with vertically adjacent blocks oriented in one of:

(i) a first bearing surface-to-first bearing surface engagement; and (ii) a second bearing surface-to-second bearing surface engagement.

33. A multi-block section of a vertical wall comprising first, second, third and fourth wall blocks configured according to the set of claim 24 oriented:

(a) with horizontally adjacent blocks positioned head-to-toe with the first face of one adjacent the second face of another; and, (b) with vertically adjacent blocks oriented in one of:

(i) a first bearing surface-to-first bearing surface engagement; and (ii) a second bearing surface-to-second bearing surface engagement.

34. A set of wall blocks usable selectively to form a section of a set back wall and also usable selectively to form a section of a vertical wall; the set comprising:

(a) a plurality of first wall blocks each comprising a first block body having: first and second, opposite, bearing surfaces; first and second, opposite, block sides; a first, exposure, face; and, a second face opposite the first exposure face; the first block body further including:

(i) a locator projection arrangement on the first bearing surface;

(ii) a recess arrangement in the first bearing surface; and, (iii) an engagement surface arrangement; the locator projection arrangement, engagement surface arrangement and recess arrangement being configured so that:

(A) when the first wall block is oriented in either one of two head-to-head, half-overlap, on bond, setback relationships with an identical block in a section of a mortarless set back wall, the locator projection arrangement of a lower one of the blocks, when directed upwardly, is engaged by the engagement surface arrangement of an upper one of the blocks, when the upper block is oriented with the locator projection arrangement also directed upwardly, to define a selected set back S2; and, (B) when the first wall block is oriented below, and in any one of four half-overlap, on bond, vertical relationships, with an identical, inverted wall block in a section of a vertical wall without set back, with the first bearing surface of each directed in the same direction as the first bearing surface of the other, the locator projection arrangement of each projects into the recess arrangement on the first bearing surface of the other; the four vertical relationships comprising: two head-to-head, half-overlap, on bond, relationships; and, two head-to-tail, half-overlap, on bond, relationships; and, (b) a plurality of second wall blocks each of different size than the first wall blocks and comprising a second block body having: first and second, opposite, bearing surfaces; first and second, opposite, block sides; a first, exposure, face; and, a second face opposite the first, exposure, face; the second block body further including:

(i) a locator projection arrangement on the first bearing surface;

(ii) a recess arrangement in the first bearing surface; and, (iii) an engagement surface arrangement; the locator projection arrangement, engagement surface arrangement and recess arrangement being configured so that:

(A) when the second wall block is oriented in either one of two head-to-head, half-overlap, on bond, setback relationships with another identical, block in a section of a mortarless set back wall, the locator projection arrangement of a lower one of the wall blocks, when directed upwardly, is engaged by the engagement surface arrangement of an upper one of the second wall blocks, when the upper wall block is oriented with the locator projection arrangement also directed upwardly, to define a selected set back S1, wherein S1 is one-half S2; and, (B) when the second wall block is oriented below, and in any one of four half-overlap, on bond, vertical relationships, with an identical, inverted, wall block in a section of a vertical wall without set back, with the first bearing surface of each directed toward the first bearing surface of the other, the locator projection arrangement of each projects into the recess arrangement on the first bearing surface of the other; the four vertical relationships comprising: two head-to-head, half-overlap, on bond relationships; and, two head-to-tail, half-overlap, on bond relationships;

(c) each first wall block and each second wall block being configured to provide a setback, when oriented in a section of a setback wall with each one of:

(i) one of the first wall blocks above and in setback engagement orientation with an identical first wall block with each block oriented with the first bearing surface directed the same direction, to define a setback S2;

(ii) one of the second wall blocks above and in set back engagement with an identical second wall block; with each block oriented with the first bearing surface directed in the same direction, to define a setback S1;

(iii) one of the first wall blocks above and in set back engagement with one of the second wall blocks with each block oriented with first bearing surface directed in the same direction, to define a setback S2; and, (iv) one of the second wall blocks above and in set back engagement with one of the first wall blocks with each block oriented with the first bearing surface directed in the same direction, to define a setback S1.

35. A wall block comprising:

a block body having:

(a) first and second, opposite, bearing surfaces; first and second, opposite, block sides; a first, exposure, face; and, a second face opposite the first, exposure, face;

(b) a locator projection arrangement on the first bearing surface;

(i) the locator projection arrangement being surrounded by an adjacent trough arrangement;

(c) an engagement surface arrangement; the locator projection arrangement and engagement surface arrangement being configured so that:

(i) when the wall block is oriented in either one of two head-to-head, half-overlap, on bond, setback relationships with a second, identical, block in a section of a mortarless set back wall, the locator projection arrangement of a first, lower, one of the wall blocks, when directed upwardly, is engaged by the engagement surface arrangement of a second, upper, one of the blocks, when the second block is oriented with the locator projection arrangement also directed upwardly, to define a selected set back.

36. A wall block according to claim 35 wherein:

the trough arrangement has a length within the range of 0.02-0.1 inches.

37. A wall block according to claim 35 wherein:

the locator projection arrangement comprises single projection.

* * * * *